US008320785B2

(12) United States Patent
Ishida

(10) Patent No.: US 8,320,785 B2
(45) Date of Patent: Nov. 27, 2012

(54) IMAGE FORMING APPARATUS FEATURING A CONTROLLER FOR CONTROLLING THE SUPPLY OF TONER OR ABRASIVE PARTICLES

(75) Inventor: Yusuke Ishida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 401 days.

(21) Appl. No.: 12/683,619

(22) Filed: Jan. 7, 2010

(65) Prior Publication Data

US 2010/0189454 A1 Jul. 29, 2010

(30) Foreign Application Priority Data

Jan. 23, 2009 (JP) ..... 2009-012473

(51) Int. Cl.
*G03G 15/00* (2006.01)
*G03G 15/08* (2006.01)
*G03G 21/00* (2006.01)

(52) U.S. Cl. ..... 399/71; 399/53; 399/347

(58) Field of Classification Search ..... 399/53, 399/55, 71, 347, 343
See application file for complete search history.

(56) References Cited

U.S. PATENT DOCUMENTS 4,972,233 A * 11/1990 Yamazaki et al. ..... 399/347
5,003,354 A * 3/1991 Takamiya et al. ..... 399/347
5,115,280 A * 5/1992 Hamada et al. ..... 399/343 X
5,151,744 A * 9/1992 Lundy et al. ..... 399/71
6,125,257 A * 9/2000 Sekine et al. ..... 399/343 X
6,311,037 B1 * 10/2001 Hisakuni et al. ..... 399/347 X
7,378,205 B2 5/2008 Sekiya et al.
2005/0019684 A1 1/2005 Sekiya et al.
2007/0212082 A1 * 9/2007 Hisakuni ..... 399/38
2007/0292152 A1 12/2007 Ishida
2008/0124124 A1 5/2008 Ishida

FOREIGN PATENT DOCUMENTS

JP 9-22168 A 1/1997
JP 2000-47545 A 2/2000
JP 2005-266544 A 9/2005
JP 2006-53168 A 2/2006

* cited by examiner

*Primary Examiner* — Sandra Brase
(74) *Attorney, Agent, or Firm* — Fitzpatrick, Cella, Harper & Scinto

(57) ABSTRACT

An image forming apparatus includes first and second image forming portions. The first and second image forming portions forms a toner image. The second image forming portion forms a toner image so that the toner image is superimposed on the toner image formed by the first image forming portion. The second image forming portion includes an image bearing member, a cleaning member that removes transfer residual toner existing on the image bearing member at an abutting position, and a supply unit that supplies abrasive particles or toner to the abutting position. The image forming apparatus includes a controller that controls the amount of toners or abrasive particles, which are supplied by the supply unit, in accordance with the amount of toner used in the first and second image forming portions.

8 Claims, 12 Drawing Sheets

NORMAL TIME

WHEN OPERATION FOR REMOVING ABRASIVE PARTICLES IS SET BETWEEN SHEETS

NORMAL TIME

WHEN Vback POTENTIAL IS SET TO 200 V BETWEEN SHEETS

NORMAL TIME

WHEN ABRASIVE PARTICLES IS SUPPLIED BETWEEN SHEETS

IMAGE FORMING APPARATUS FEATURING A CONTROLLER FOR CONTROLLING THE SUPPLY OF TONER OR ABRASIVE PARTICLES

BACKGROUND OF THE INVENTION

1. Field of the Invention

The present invention relates to an image forming apparatus, such as a copying machine or a laser beam printer, using an electrophotographic system or an electrostatic recording system that develops an electrostatic latent image formed on an image bearing member by using a developer, which includes toner and a carrier.

2. Description of the Related Art

Conventionally, an image forming apparatus, such as a facsimile, a printer, or a copying machine using an electrophotographic system has generally formed images by repeatedly performing electrophotographic processes (a charging process, an exposure process, a developing process, a transfer process, and a cleaning process) on an electrophotographic photoreceptor (photoreceptor) that is an image bearing member. The image forming apparatus includes a charging device, an exposure device, a developing device, a transfer device, a cleaning device, a fixing device, and the like in addition to a photoreceptor. The charging device (charging process) uniformly charges the photoreceptor with a predetermined polarity and an electric potential. The exposure device (exposure process) forms an electrostatic latent image on the charged photoreceptor. The developing device (developing process) visualizes the electrostatic latent image, which is formed on the photoreceptor, as a toner image by using a developer. The transfer device (transfer process) transfers the toner image to a recording material such a paper sheet from the surface of the photoreceptor. The cleaning device (cleaning process) cleans the surface of the photoreceptor by any removing residues (residual developer and transfer residual toner) remaining on the photoreceptor after the transfer process. The fixing device (fixing process) fixes the toner image onto the recording material.

Further, in recent years, a tandem image forming system has been used due to the demand for the increase in speed of the full-color image forming apparatus. The tandem image forming system includes photoreceptors, charging devices, exposure devices, and developing devices, which correspond to four colors (for example, yellow, magenta, cyan, and black), and these devices are disposed in parallel so that an image is formed in each of units. Since images corresponding to four colors can be simultaneously formed by the tandem image forming system, it may be possible to output an image at high speed.

Meanwhile, it is known that corona products, which are generated due to the existence of high-voltage members, such as charging members and transfer members, in the apparatus, are attached to the surface of the photoreceptor as foreign materials. Accordingly, particularly, resistance is lowered under a high-humidity environment, so that the formation of a clear electrostatic latent image is hindered and the deterioration of image quality is caused (image deletion). As factors that cause the image deletion, there are ingredients that form nitrate ions by the oxidation of nitrogen contained in the air as well as the generation of various metal oxides or oxygen compounds during corona discharge. Further, since the corona products are attached to the surface of the photoreceptor, a thin film (hereinafter, referred to as a filming layer) is formed on the surface of the photoreceptor. Accordingly, the photoreceptor absorbs moisture under a high-humidity environment, so that resistance is lowered. For this reason, the formation of a clear electrostatic latent image is hindered. These become factors that cause the deterioration of image quality.

A drum heater is mounted in the photoreceptor in order to suppress the image deletion (Japanese Patent Application Laid-Open (JP-A) No. 9-22168).

However, the image forming apparatus has been reduced in size, manufacturing cost, and energy consumption in recent years. Accordingly, the mounting of the drum heater causes problems, such as the securing of the space required for the disposition of the heater, the increase of manufacturing cost, and the increase of power consumption.

Further, there has been a method of suppressing image deletion by scraping attached corona products together with the surface layer of a photoreceptor while rubbing the surface of the photoreceptor by a cleaning device. However, as disclosed in JP-A No. 2006-53168, the hardness of the surface of a photoreceptor has been increased in recent years in order to increase the life of a photoreceptor. For this reason, it has been difficult to remove corona products by rubbing of the surface of the photoreceptor.

Furthermore, as disclosed in JP-A No. 2000-47545, there has been known a method of removing discharge products by depositing abrasive particles on a cleaning device, which comes into contact with a photoreceptor, from a developing device via the photoreceptor, after abrasive particles for abrading the surface of the photoreceptor are mixed in a developer in the developing device. The abrasive particle has an opposite-polarity that is opposite to a polarity of toner (for example, if toner has a negative polarity, the abrasive particle has a positive polarity). Accordingly, the abrasive particles are developed in a blank (fog removing bias, Vback) on the sheet, are hardly transferred since having the opposite-polarity that is opposite to the polarity of toner, and are collected by the cleaning device.

However, as described in JP-A No. 2000-47545, image deletion conventionally has been suppressed by unilaterally supplying abrasive particles to the cleaning device and collecting the abrasive particles on the cleaning member of the cleaning device that comes into contact with the photoreceptor. However, there were problems in the above-mentioned tandem full-color image forming system. That is, abrasive particles, which are generated from an image forming unit (first image forming portion) provided on the upstream side in a moving direction of a member to be transferred, are retransferred to an image forming unit (second image forming portion), which is provided on the downstream side, through the member to be transferred, so that the retransferred abrasive particles are attached to the cleaning member. For this reason, many abrasive particles are attached to the cleaning member of the image forming unit that is provided on the downstream side. As a result, all abrasive particles are not collected on the cleaning member of the image forming unit that is provided on the downstream side, so that abrasive particles contaminate a charging member and the photoreceptor. Accordingly, image defects have been caused or the life of the photoreceptor has been shortened.

Furthermore, the tandem image forming system generates not only transfer residual toner that is generated in each of the image forming units but also toner (retransfer toner) that is generated by the partial retransfer of the toner image formed in the image forming unit (first image forming portion) provided on the upstream side. If the retransfer toner is generated, a large amount of toner is attached to the cleaning member of the image forming unit (second image forming portion) that is provided on the downstream side. As a result, the amount of abrasive particles attached to the cleaning member of the image forming unit provided on the downstream side is decreased, therefore, image deletion has been caused.

SUMMARY OF THE INVENTION

Accordingly, the invention has been made to solve the above-mentioned problems and is to suppress the instability of the amount of abrasive particles (which are supplied to a cleaning member of a second image forming portion) caused by a developer that is retransferred from a first image forming portion.

In order to achieve the object, an image forming apparatus has a first image forming portion that forms a toner image; and a second image forming portion that forms a toner image, wherein the second image forming portion forms a toner image so that the toner image is superimposed on the toner image formed by the first image forming portion, wherein the second image forming portion includes an image bearing member, a cleaning member that removes toner existing on the image bearing member by abutting the image bearing member at an abutting position, and a supply unit that supplies abrasive particles or toner to the abutting position, and the image forming apparatus includes a controller that controls the amount of toners or abrasive particles, which are supplied by the supply unit, in accordance with the amount of toner used in the first and second image forming portions.

Further features of the present invention will become apparent from the following description of exemplary embodiments with reference to the attached drawings.

DESCRIPTION OF THE EMBODIMENTS

Exemplary embodiments of the invention will be described in detail below with reference to drawings. However, the dimensions, materials, shapes, relative disposition, and the like of components described in the following embodiments should be appropriately changed in accordance with the structure or various conditions of apparatus to which the invention is applied. Accordingly, as long as there is no specific description, the scope of the invention is not limited thereto.

First Embodiment

Figure 1:
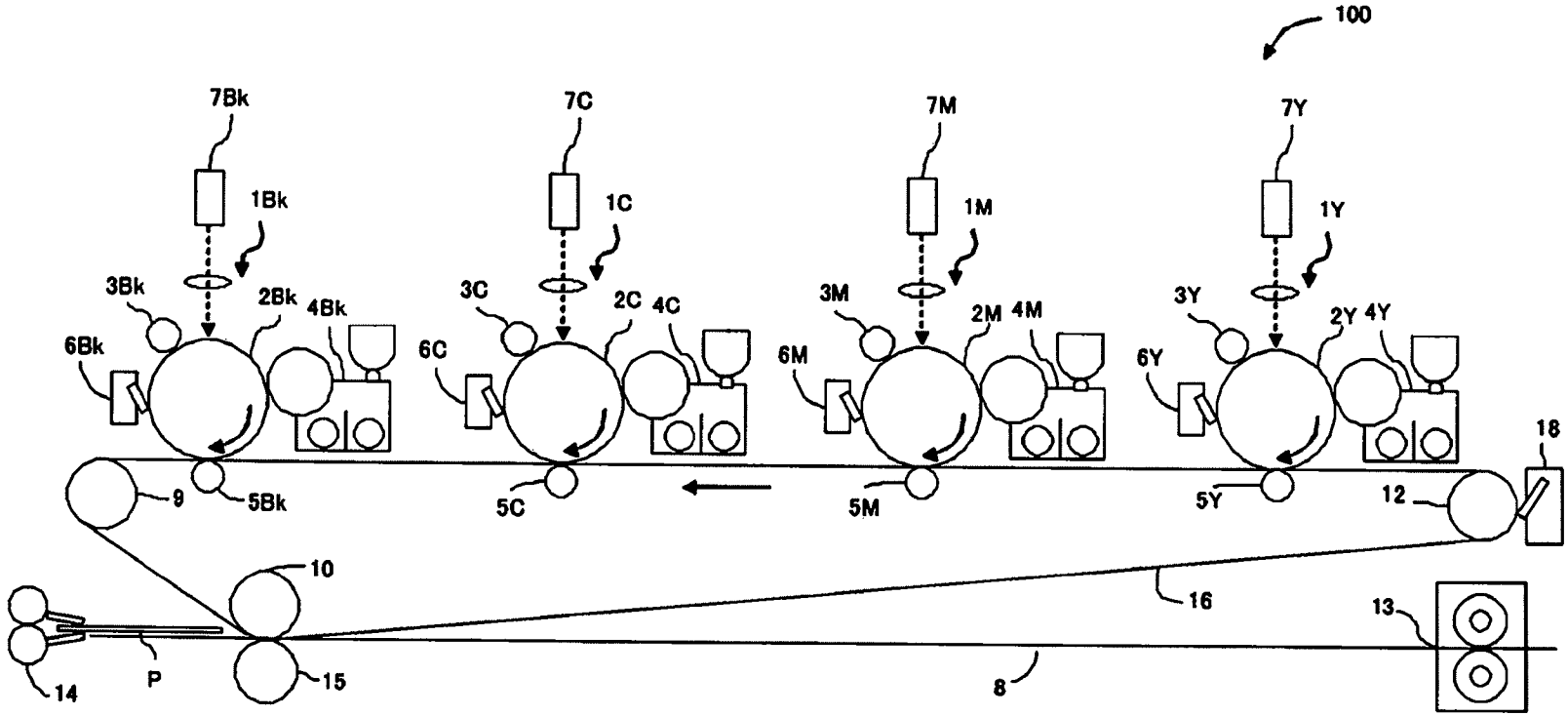
FIG. 1 is a schematic view illustrating the structure of an image forming apparatus.

First, the entire structure and operation of an image forming apparatus will be described with reference to FIG. 1. FIG. 1 is a schematic view illustrating the structure of an image forming apparatus. Here, an electrophotographic full-color printer is exemplified as the image forming apparatus.

An image forming apparatus 100 includes first and second image forming portions. The first image forming portion forms a first toner image on a first image bearing member by using a developer, and transfers the first toner image to an intermediate transfer member. The second image forming portion forms a second toner image on a second image bearing member by using a developer, and transfers the second toner image to the first toner image formed on the intermediate transfer member so that the second toner image is superimposed on the first toner image. That is, the second image forming portion is provided so as to be able to form an image by superimposing an image on the toner image that is formed by the first image forming portion (so as to be able to transfer an image on the toner image that is formed by the first image forming portion).

Further, as described below, the second image forming portion is abutted against the second image bearing member, and includes a cleaning member that removes toner existing on the second image bearing member and a supply unit that supplies abrasive particles to the cleaning member. Here, the image forming apparatus includes four image forming portions (hereinafter, referred to as image forming units) 1Y, 1M, 1C, and 1Bk, which are provided so as to correspond to four colors (yellow (Y), magenta (M), cyan (C), and black (Bk)), as the first and second image forming portions. Here, an electrophotographic full-color printer is exemplified as the image forming apparatus. In this embodiment, the first image forming portion corresponds to three image forming units, that is, yellow (Y), magenta (M), and cyan (C) image forming units, and the second image forming portion correspond to a black (Bk) image forming unit.

The image forming apparatus 100 may form a full-color image having four colors on a recording material in accordance with an image signal output from a host device such as a document reading device (not illustrated) connected to a main body of the image forming apparatus or a personal computer that is communicatively connected to the main body. Examples of the recording material include a recording sheet, a plastic film, a cloth, and the like. The respective image forming units 1Y, 1M, 1C, and 1Bk are adapted to transfer toner images, which are formed on photosensitive drums 2Y, 2M, 2C, and 2Bk as image bearing members, to the intermediate transfer belt 16 so that the toner images are sequentially superimposed thereon, and then to transfer the toner images onto a recording material P that is conveyed by a recording material bearing member 8. These will be described in detail below.

Here, the four image forming units 1Y, 1M, 1C, and 1Bk of the image forming apparatus 100 have substantially the same structure except for different developing colors. Accordingly, as long as the image forming units do not need to be specifically distinguished from each other, letters Y, M, C, and Bk added to reference numerals are omitted to mean that elements belong to any one of image forming units, and the elements will be generally described.

The image forming unit 1 is provided with a cylindrical photoreceptor, that is, a photosensitive drum 2 as an image bearing member. The photosensitive drum 2 is rotationally driven in a direction of an arrow in the drawing.

A charging roller 3 as a charging portion, a developing device 4 as a developing portion, a primary transfer roller 5 as a transfer portion, and a cleaning device 6 as a cleaning portion are disposed around the photosensitive drum 2. An exposure device (laser scanner) 7 as an exposure portion is disposed above the photosensitive drum 2 in FIG. 1. Further, the intermediate transfer belt 16 as an intermediate transfer member is disposed so as to face the photosensitive drum 2 of each of the image forming units 1.

The intermediate transfer belt 16, which is an endless belt, is stretched around a driving roller 9, a driven roller 12, and a secondary transfer counter roller 10. The intermediate transfer belt is rotated in a direction of an arrow in the drawing by the drive of the driving roller 9, and conveys the toner images to an abutting position (secondary transfer position) where the intermediate transfer belt is abutted against the recording material P. A secondary transfer roller 15 and the secondary transfer counter roller 10 are disposed at the secondary transfer position where the toner image transferred to the intermediate transfer belt 16 is transferred to the recording material P conveyed by the recording material bearing member 8. Subsequently, after the toner image is transferred to the recording material P from the intermediate transfer belt 16, the toner image is thermally fixed to the recording material P by a fixing device 13.

For example, the formation of the full-color image having four colors will be described. First, when an image forming operation starts, the surface of the rotating photosensitive drum 2 is uniformly charged with electricity by the charging roller 3. In this case, a charging bias is applied to the charging roller 3 by a charging bias power source. After that, the photosensitive drum 2 is exposed to a laser beam that is emitted from an exposure device 7 and corresponds to the image signal. Accordingly, an electrostatic image (latent image) corresponding to the image signal is formed on the photosensitive drum 2. The electrostatic image formed on the photosensitive drum 2 is visualized by toner that is stored in the developing device 4, and is changed into a visible image. Here, there is used a reversal development method of attaching toner to a bright portion potential that is exposed to a laser beam.

A toner image is formed on the photosensitive drum 2 by the developing device 4, and is primarily transferred onto the intermediate transfer belt 16. Residues such as toner, which remains on the photosensitive drum 2 after primary transfer, are removed by the cleaning device 6.

This operation is sequentially performed in order of yellow, magenta, cyan, and black, and toner images corresponding to four colors are superimposed on the intermediate transfer belt 16. After that, the recording material P, which is stored in a recording material storing cassette (not illustrated), is fed by a supply roller 14 in synchronization with the timing of forming the toner image and is conveyed by the recording material bearing member 8. Further, the toner images, which correspond to four colors and are formed on the intermediate transfer belt 16, are collectively and secondarily transferred onto the recording material P, which is supported on the recording material bearing member 8, by applying a secondary transfer bias to the secondary transfer roller 15.

After that, the recording material P is separated from the recording material bearing member 8 and conveyed to the fixing device 13 as a fixing portion. The toner existing on the recording material P is melted and mixed by being pressed and heated by the fixing device 13, thereby forming a full-color permanent image. Then, the recording material P is discharged to the outside of the apparatus.

Furthermore, the toner, which is not removed by a secondary transfer portion and remains on the intermediate transfer belt 16, is removed by an intermediate transfer belt cleaner 18. Accordingly, a series of operation is completed.

Meanwhile, a monochromatic image corresponding to a desired color or a multicolored image may be formed by using only desired image forming units.

Figure 2:
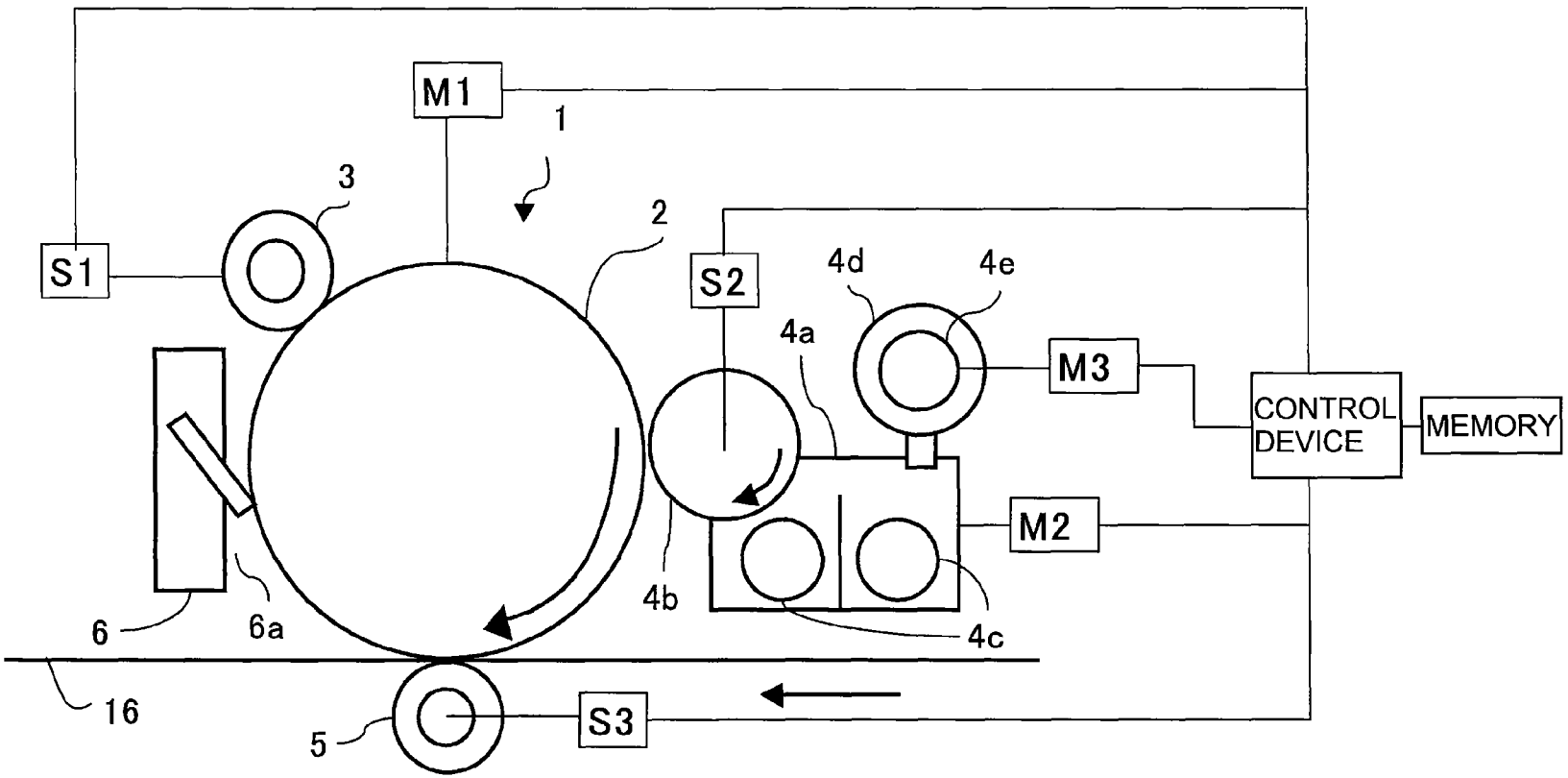
FIG. 2 is a schematic view illustrating the structure of an image forming unit.

The operation of the image forming unit 1 will be described in detail below with reference to FIG. 2. FIG. 2 is a view illustrating the image forming unit.

In this embodiment, the photosensitive drum 2 is a negatively charged organic photoconductor (OPC) of which a charge property is negative, having the outer diameter of 30 mm and is driven so as to rotate about a central shaft in a counterclockwise direction at a process speed (peripheral speed) of 130 mm/sec.

The photosensitive drum will be described in detail below.

In this embodiment, the type of each of the yellow, magenta, cyan photosensitive drums is different from the type of the black photosensitive drum. Specifically, a photosensitive drum in the related art, which uses a thermosetting resin, is employed as each of the yellow, magenta, and cyan photosensitive drums. A photosensitive drum, which uses a photocurable resin (electron beam curable resin) of which surface hardness is higher than the surface hardness of a thermosetting resin, is employed as the black photosensitive drum.

Since office users and the like generally tend to relatively frequently form a black (monochromatic) image in comparison with a full-color image, the photosensitive drum using a photocurable resin is employed as the black photosensitive drum in order to increase the life of the black photosensitive drum.

Meanwhile, a photosensitive drum using a photocurable resin increases cost in comparison with a photosensitive drum using a thermosetting resin. For this reason, if a photosensitive drum using a photocurable resin is employed as each of the yellow, magenta, and cyan photosensitive drums, over specification is applied for a user that less frequently forms a full-color image. Accordingly, there is a problem in that the user may not obtain a merit in cost.

The photosensitive drum employed in this embodiment will be described herein in detail.

In the structure of the photosensitive drum, a photosensitive layer and a protective layer are sequentially laminated on a conductive support and the protective layer contains at least a curable resin and conductive particles.

Examples of the conductive particles used in the protective layer include metal, metal oxides, and carbon black. These may be used alone, and the combination of two or more of them may be used. It is preferable that the mean particle size of the conductive particles be 0.3 μm or less, particularly, 0.1 μm or less in terms of transparency of the protective layer. Further, it is particularly preferable to use the metal oxides among the examples of the above-mentioned conductive particles in terms of transparency.

Further, resin particles containing fluorine atoms may be dispersed in order to improve the slidability of the surface of the photosensitive drum. The molecular weight or particle size of the resin particles may be appropriately selected, and is not particularly limited. The surface of the conductive particles may be treated by compounds containing fluorine atoms so that the resin particles containing fluorine atoms and the conductive particles do not cohere to each other in a resin solution. It may be possible to improve the dispersibility of the resin particles containing fluorine atoms and the conductive particles in the resin solution by the surface treatment. Further, it may also be possible to improve the stability of dispersion of the particles without the secondary formation of particles that occurs with time.

As described above, as for the black photosensitive drum of this embodiment, a photocurable resin is used as a binder resin for the protective layer in terms of the surface hardness, abrasion resistance, and scratch resistance of the protective layer, and is cured by the irradiation of an electron beam. The photocurable resin indicates an oligomer or a monomer, which includes a functional group and causes a polymerization reaction by the energy of an electron beam. A relatively large molecule where a structural unit of a molecule is repeated 2 to 20 times is defined as an oligomer, and a molecule where a structural unit of a molecule is repeated 2 to 20 times or less is defined as a monomer. Examples of a functional group causing a polymerization reaction include a group having a carbon-carbon double bond, a group causing ring-opening polymerization, and a group that causes polymerization through the reaction of two or more kinds of molecules. In particular, in this embodiment, it is preferable that a resin including a methacryloyloxy group (CH2=C(CH3)COO—) or an acryloyloxy group (CH2=CHCOO—) having a carbon-carbon double bond be used as the curable resin among them described above. When an electron beam is irradiated, any one of a scanning type accelerator, an electrocurtain type accelerator, a broad beam type accelerator, a pulse type accelerator, laminar accelerator, and the like may be used as an accelerator. When an electron beam is irradiated, irradiation conditions are very important in exerting electrical properties and durability performance of the photosensitive drum of this embodiment. In this embodiment, an accelerating voltage is preferably 250 kV or less and more preferably 150 kV or less. Further, a dose is preferably in the range of 1 to 100 Mrad and more preferably in the range of 3 to 50 Mrad. If an accelerating voltage is equal to or higher than the above-mentioned value, the damage of the irradiation of an electron beam to the properties of a photoreceptor becomes significant. Furthermore, if a dose is lower than the above-mentioned range, curing is not sufficient, therefore, the properties of a photoreceptor deteriorate when a dose is excessively high.

The reason why excellent scrape resistance and scratch resistance are obtained when a protective layer made of a curable resin containing conductive particles is cured by the irradiation of an electron beam is considered from the merits of an electron beam in comparison with heat or ultraviolet light as follows:

In the case of thermal curing, the amount of heat required to completely cure the protective layer is very large and the heat deteriorates the photosensitive layer that is provided below the protective layer. For this reason, in the past, the protective layer was formed while a sufficient amount of heat is not applied, so that the hardness of the protective layer was not sufficient.

When ultraviolet light is used, it is considered that the conductive particles absorb ultraviolet light and the curing of the resin near the conductive particles is thus hindered. For this reason, in the past, in a system of the protective layer where conductive particles are dispersed, a plurality of uncured portions has been generated at micro portions in the protective layer, so that a three-dimensional cross-linking reaction is stopped in the protective layer. Accordingly, it is considered that the macro surface hardness of the entire of the protective layer is lowered.

Further, in an ultraviolet curing system, as described above, a polymerization initiator needs to be used in a resin for curing. Furthermore, from the investigation of inventors, it is found out that hardness may not be increased unless a large amount of polymerization initiator is added in a system where conductive particles and the like are mixed. In contrast, it is also found out that surface hardness is lowered in a system where a large amount of polymerization initiator is unnecessarily mixed in a resin containing no conductive particles. Even though the amount of a polymerization initiator is optimized, a protective layer of a conductive particles dispersed system may not obtain high hardness and it is considered that the scrape resistance and scratch resistance of the photoreceptor manufactured by the above-mentioned method deteriorate.

In contrast, the protective layer cured by the irradiation of an electron beam is advantageous, since a polymerization initiator does not need to be added thereto. Further, since the irradiation energy of an electron beam is also much larger than that of ultraviolet light and the transmission depth of the electron beam to a sample is also very large, the resin near the conductive particles is also cured. Accordingly, it is considered that the high-surface hardness of the protective layer may be achieved and the manufactured protective layer has excellent scrape resistance and scratch resistance.

A photosensitive drum, which uses a thermosetting resin in the related art, is employed as each of the yellow, magenta, and cyan photosensitive drums of this embodiment.

The photosensitive layer of the photosensitive drum, which is used in this embodiment, and the structure provided below the photosensitive layer will be described below. Here, a structure, where a charge generating layer containing a charge generating material and a charge transport layer containing a charge transport material are laminated on the conductive support in this order or in reverse order, may be employed as the structure provided below the photosensitive layer. Further, a structure formed of a single layer where a charge generating material and a charge transport material are mixed and dispersed in the same layer may also be employed as the structure provided below the photosensitive layer.

Moreover, the photosensitive, layer may be made of not an organic photoconductive material but an inorganic photoconductive material. For example, the photosensitive layer may be made of Se, $As_2Se_3$, a-Si, CdS, $ZnO_2$, and the like.

However, considering a property such as residual charge that is a property of an electrophotographic photoreceptor, a function separation type photoreceptor where the charge transport layer and the charge generating layer made of an organic photoconductive material are laminated is particularly preferable.

When the electrophotographic photoreceptor of this embodiment is manufactured, the conductive support may be made of metal such as aluminum or stainless steel, an alloy, paper, or plastics, and the conductive support may have an arbitrary shape, such as a cylindrical shape or a film shape, in accordance with an electrophotographic apparatus where the electrophotographic photoreceptor is to be applied. Further, a structure where a conductive layer is separately formed on a non-conductive support by a deposition method or other methods may be used as the conductive support.

In this embodiment, an under coating layer, which has a function of a barrier and an adhesive function, may be formed on the conductive support.

The under coating layer is formed for the improvement of an adhesion property of the photosensitive layer, the improvement of a coating property, the protection of the support, the coating of a base substance, the improvement of an charge injection property from the support, the protection of the photosensitive layer from electrical destruction, and the like. This is dissolved in an appropriate solvent, and is applied on the support. In this case, it is preferable that the thickness of the applied solution be in the range of about 0.1 to 2 μm.

Examples of the charge generating material used for the charge generating layer of this embodiment include selenium-tellurium, pyrylium, thiapyrylium-based dyes, various kinds of central metal, a crystal system, and the like.

The charge generating layer is formed by dispersing the charge generating material in a solvent and a binder resin of which the amount is 0.3 to 4 times of the amount of the charge generating material, applying and drying the dispersion liquid. Alternatively, the charge generating layer is formed of a film containing only one element, such as a deposited film made of the charge generating material. It is preferable that the thickness of the film be 5 μm or less, particularly, in the range of 0.1 to 2 μm.

It is preferable that the charge transport layer formed on the charge generating layer be formed by applying the solution, which is obtained by dissolving the charge generating material and an appropriate resin in a solvent, and drying the solution. The resin may be selected from a broad range of binder resins. Resins on the market, for example, a polycarbonate resin, a polyarylate resin, a polystyrene resin, and the like may be used as the resin. However, the resin is not limited thereto. Each of the resins may be used alone, or one or more of the resins may be mixed and used as a copolymer.

As illustrated in FIG. 2, the image forming unit includes a contact charging device 3 as a charging portion that uniformly charges the surface of the photosensitive drum 2 with electricity. In this embodiment, the contact charging device 3 is a charging roller (roller charging type device), and charges the surface of the photosensitive drum with electricity by using a discharge phenomenon that occurs at a small gap between the photosensitive drum 2 and the contact charging device. A charging bias voltage corresponding to predetermined conditions is applied to the charging roller 3 from a power source S1. Accordingly, contact charging is performed on the surface of the rotating photosensitive drum 2 with a predetermined polarity and electric potential. In this embodiment, a charging bias voltage applied to the charging roller 3 is an oscillating voltage where a DC voltage Vdc and an AC voltage Vac are superimposed. More specifically, the charging bias voltage to the charging roller is an oscillating voltage where a DC voltage of −500V, a frequency of 1.3 kHz, a peak-to-peak voltage Vpp of 1.5 kV, and an AC voltage of a sine wave are superimposed. Contact charging is uniformly performed on the surface of the photosensitive drum 2 by the charging bias voltage with −500V (dark potential Vd) that is equal to the DC voltage applied to the charging roller 3.

In this embodiment, the developing device 4 is a developing device employing a two-component contact developing system that performs development while a magnetic brush, which is formed of toner and a carrier, comes into contact with the photosensitive drum 2. The developing device 4 includes a developing container 4*a*, and a non-magnetic developing sleeve 4*b* as a developer bearing member. The developing sleeve 4*b* is rotatably disposed in the developing container 4*a* so that a part of an outer peripheral surface of the developing sleeve is exposed to the outside of the developing device 4. A magnet roller (not illustrated) is non-rotationally and fixedly inserted into the developing sleeve 4*b*. The developing container 4*a* stores a two-component developer, and developer agitating members 4*c* are disposed at the bottom in the developing container 4*a*. Further, toner to be supplied is stored in a toner hopper 4*d*.

The two-component developer (developer) stored in the developing container 4*a* is mainly a mixture of non-magnetic toner and a magnetic carrier, and is agitated by the developer agitating members 4*c*. In this embodiment, the toner contains a binding resin, a colorant, and colored resin particles that include other additives as needed. The toner is a negatively charged polyester resin that is manufactured by a polymerization method, and it is preferable that the volume mean particle size of the toner be in the range of 5 to 8 μm. In this case, the volume mean particle size of the toner was 6.2 μm. The toner is frictionally charged with electricity so as to have a negative polarity by friction against the magnetic carrier.

For example, metal, such as surface-oxidized or unoxidized iron, nickel, cobalt, manganese, chrome, and rare earthes, alloys thereof, or oxide ferrite may be preferably used as the carrier. A method of manufacturing magnetic particles of them is not particularly limited. Further, the weight mean particle size of the carrier is in the range of 20 to 50 μm, and preferably in the range of 30 to 40 μm. The resistivity of the carrier is $10^7$ Ω·cm or more, and preferably $10^8$ Ω·cm or more. Here, a carrier having a resistivity of $10^8$ Ω·cm was used. Further, a resin magnetic carrier, which is manufactured by a polymerization method after a magnetic metal oxide and a non-magnetic metal oxide are mixed in a phenol binder resin at predetermined ratios, was used as a low-density magnetic carrier. The volume mean particle size of the carrier is 35 μm, the true density of the carrier is in the range of 3.6 to 3.7 g/cm$^3$, and the amount of magnetization is 53 A·m$^2$/kg.

The developing sleeve 4*b* is disposed close to the photosensitive drum 2 so as to face the photosensitive drum 2 so that the closest distance (S-Dgap) between the photosensitive drum and the developing sleeve becomes 350 μm. A position where the photosensitive drum 2 faces the developing sleeve 4*b* is a developing position. The developing sleeve 4*b* is driven at the developing position so as to rotate in a direction opposite to the rotation direction of the photosensitive drum 2. A part of the two-component developer stored in the developing container 4*a* is absorbed and held as a magnetic brush layer on the outer peripheral surface of the developing sleeve 4*b* by a magnetic force of the magnet roller inserted into the developing sleeve 4*b*. As the developing sleeve 4*b* is rotated, the magnetic brush layer is rotated and conveyed, comes into contact with the surface of the photosensitive drum 2, and is rubbed against the surface of the photosensitive drum at the developing position. A predetermined developing bias voltage is applied to the developing sleeve 4*b* from a power source S2. In this embodiment, the developing bias voltage applied to the developing sleeve 4*b* is an oscillating voltage where a DC voltage Vdc an AC voltage Vac are superimposed. More specifically, the developing bias voltage is an oscillating voltage where a DC voltage of −350V, a frequency of 8.0 kHz, a peak-to-peak voltage of 1.8 kV, and an AC voltage of a rectangular wave are superimposed. The toner of the developer, which is coated on the surface of the rotating developing sleeve 4*b* as a thin film and conveyed to the developing position, is selectively attached to the surface of the photosensitive drum 2 so as to correspond to an electrostatic latent image by an electric field that is generated by a developing bias. Then, the electrostatic latent image is developed as a toner image. Subsequently, the developer thin film coated on the developing sleeve 4*b*, which has passed through the developing position, returns to a developer storing part in the developing container 4*a* as the developing sleeve 4*b* is rotated. In order to maintain the toner concentration of the two-component developer, which is stored in the developing container 4*a*, in a substantially constant range, the toner concentration is detected by, for example, an optical toner concentration sensor (not illustrated). Further, the rotation of a toner supply screw 4*e*, which is disposed in the toner hopper 4*d*, is controlled in accordance with the detection information of the optical toner concentration sensor, so that toner is supplied to the developing container 4*a*. The toner, which is supplied to the developing container 4*a* from the toner hopper 4*d*, is agitated by the agitating members 4*c*.

Figure 3:
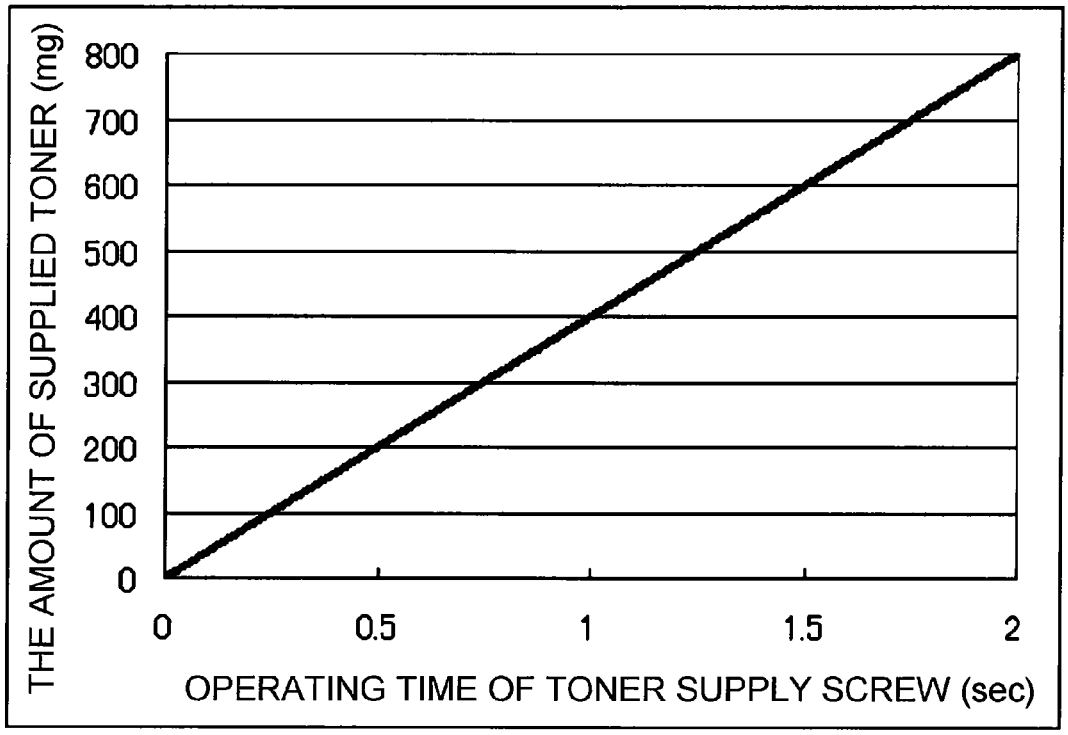
FIG. 3 is a view illustrating a relationship between the operating time of a toner supply screw and the amount of supplied toner.

As illustrated in FIG. 3, the toner supply screw 4*e* of this embodiment is controlled so that toner of 400 mg is supplied per 1 sec of the operating time of a supply screw.

In this embodiment, a primary transfer device (transfer portion) 5, which transfers the toner images formed on the photosensitive drum 2 to the intermediate transfer belt 16, is a transfer roller. The primary transfer roller 5 comes in press contact with the photosensitive drum 2 by a predetermined pressing force with the intermediate transfer belt 16 interposed between. A transfer bias voltage (Vtr) having a positive polarity, which is the opposite-polarity opposite to a negative polarity (which is a normal charging polarity of the toner), is applied to the primary transfer roller 5 from a power source S3. Specifically, a positive transfer voltage of +2 kV is applied to the primary transfer roller 5 from the power source S3. Accordingly, the toner images formed on the photosensitive drum 2 are sequentially electrostatically transferred to the surface of the intermediate transfer belt 16.

Further, in this embodiment, the abrasive particles, which are charged with electricity so as to have the opposite-polarity that is opposite to the polarity of the toner, are contained in the developer that is stored in the black developing device and the toner to be supplied that is stored in the toner hopper. Here, the toner has a negatively charged polarity, and strontium titanate having a positively charged polarity is used as the abrasive particles. Strontium titanate used in this embodiment will be described in detail. The mean particle size of a primary particle of strontium titanate is in the range of 30 to 300 nm, the particle of strontium titanate has a cubical or rectangular parallelepiped shape, and strontium titanate has perovskite-type crystal structure. When the above-mentioned abrasive particles are used, particularly, even when the photosensitive drum having high surface hardness is used, it may be possible to effectively remove corona products. In this embodiment, the amount of added abrasive particles is 0.2% by weight with respect to the amount of toner.

If the abrasive particles are charged with electricity so as to have the opposite-polarity that is opposite to the polarity of the toner as described above, it may be possible to reduce the amount of abrasive particles to be transferred onto the intermediate transfer belt 16 as much as possible, and to stably supply the abrasive particle to the cleaning device 6. Since the abrasive particles are liberated in the developer, the abrasive particles are supplied onto the photosensitive drum 2 from the developing sleeve 4*b* mainly when a fog removing bias (Vback electric potential) is generated between the developing device and the photosensitive drum. Further, the abrasive particles are attached to a cleaning member 6*a* of the cleaning device 6 after passing through a primary transfer position where the photosensitive drum 2 and the primary transfer roller 5 face each other. Here, the fog removing bias (Vback electric potential) is 150 V.

That is, the developing device (supply unit) may supply abrasive particles and toner to the abutting position between the photosensitive drum and the cleaning member. Further, the cleaning member 6*a* of the cleaning device 6 is abutted against the photosensitive drum at the abutting position, thereby removing transfer residual toner on the photosensitive drum.

As illustrated in FIG. 2, the image forming unit of this embodiment includes the photosensitive drum, the developing device, and driving motors M1, M2, and M3 that operate the toner supply screw. Further, the operation of the driving motors M1, M2, and M3 and the above-mentioned power sources S1, S2, and S3 is controlled by a control device (controller). In this embodiment, the image forming unit also includes a storage portion (memory) that stores the amount of supplied toner.

In the above-mentioned image forming apparatus, there may be a unit that forms an image, and a unit that does not form an image during, for example, the formation of a monochromatic image. In this case, the photosensitive drum of the unit, which does not form an image, is idled while being abutted against the transfer device as during the normal formation of an image. If this method is used, there is no need to provide a mechanism for abutting/separating the transfer device against or/from the photosensitive drum. Accordingly, it may be possible to achieve the small size, low manufacturing cost, and high productivity of the image forming apparatus.

Here, there will be described problems occurring when a full-color image is formed using the yellow, magenta, cyan, and black image forming units of the image forming apparatus employing the above-mentioned structure.

The black image forming unit includes abrasive particles in the developer as described above. Accordingly, when an image having a low image ratio is formed, the amount of abrasive particles, which are supplied from the developing device and attached to the cleaning member, is increased. In contrast, when an image having a high image ratio is formed, the amount of abrasive particles, which are attached to the cleaning member, is decreased. Meanwhile, the image ratio is a ratio of an image that is formed by toner.

Further, when a full-color image is formed, a toner image, which is formed on the upstream side of the black image forming unit in the moving direction of the intermediate transfer belt, is retransferred to the photosensitive drum of the black image forming unit through the intermediate transfer belt. That is, the toner images, which are formed on the respective photosensitive drums (first image bearing members) of the image forming units 1Y, 1M, and 1C that correspond to the first image forming portion, are retransferred to the photosensitive drum (second image bearing member) of the image forming unit 1Bk, which corresponds to the second image forming portion, through the intermediate transfer belt.

Further, there has been a problem in that the retransfer toner makes the abrasive particles, which are attached to the cleaning member, fall off.

For example, when images having a low image ratio (for example, image duty of 2%) are continuously formed several times in all image forming units, many abrasive particles are supplied to the black cleaning member 6*a*. Further, since the number of images, which are formed on the upstream side of the black image forming unit, is small, the amount of retransfer toner, which is retransferred to the photosensitive drum of the black image forming unit, is very small. In this case, all abrasive particles may not be collected by the black cleaning member 6*a* and many abrasive particles are attached to the charging roller 3, so that the photosensitive drum 2 and image defects are generated due to the unevenness of charge. Further, the surface of the photosensitive drum is excessively abraded, so that the life of the photosensitive drum is shortened.

Meanwhile, when images having a high image ratio (for example, image duty of 30% or more) are continuously formed several times in all image forming units, the amount of abrasive particles to be supplied to the black cleaning member 6*a* from the black developing device is decreased. Further, since not only the amount of transfer residual toner of the image forming units but also the amount of retransfer toner are increased, the amount of toner to be supplied to the cleaning member 6*a* is increased. When the toner is collected by the cleaning member 6*a*, abrasive particles, which have been attached to the cleaning member 6*a*, are attached to the toner, and fall off from the cleaning member 6*a* together with the toner. As a result, the abrasive particles attached to the black cleaning member 6*a* are depleted, so that image deletion occurs.

Furthermore, an image having a normal image ratio (for example, image duty of 10%) is formed in the black image forming unit, and full-color images having a high image ratio (for example, image duty of 40%) are continuously formed in the yellow, magenta, and cyan image forming units. In this case, the amount of abrasive particles, which are to be supplied to the cleaning member from the developing device of the black image forming unit, is stable. However, since the number of toner images, which are formed on the upstream side of the black image forming unit, is large, the amount of retransfer toner, which is retransferred to the photosensitive drum of the black image forming unit, is large. Further, a large amount of retransfer toner is supplied to the cleaning member of the black image forming unit. As a result, the abrasive particles attached to the cleaning member 6*a* of the black image forming unit are depleted, so that image deletion occurs.

When a full-color image is formed as described above, there has been a problem in that the retransfer toner is mixed in the black image forming unit and the amount of abrasive particles attached to the black cleaning member becomes thus unstable.

Further, here, the amount of abrasive particles, which are deposited at the abutting position between the cleaning member and the photosensitive drum, is controlled by using not only the information about the amount of toner supplied to the black image forming unit but also the information about the amount of toner supplied to the image forming units that are provided on the upstream side of the black image forming unit. This will be described in detail below with reference to FIGS. 4, 5, and 6.

The above-mentioned information about the amount of supplied toner is the amount of toner supplied to the developing device when a predetermined number of images are formed (per a predetermined number of prints). Here, the operating time (time of rotation) of the toner supply screw, which is disposed in the toner hopper and supplies toner to the developing container, is used as the amount of supplied toner. The amount of supplied toner is stored in the memory as a storage portion. The structure where the memory is provided in each of the image forming units has been exemplified here, but the number and disposition of memories are not limited thereto. For example, one memory used to record the information is provided in a main body of the image forming apparatus or and a memory of the image forming apparatus main body is used, so that the information about the respective image forming units may be stored in the memory.

In this embodiment, not only the amount of toner supplied to the black image forming unit but also the amount of toner supplied to the image forming units, which are provided on the upstream side of the black image forming unit in the moving direction of the intermediate transfer belt, is detected as described below. Further, the amount of abrasive particles or toner, which is supplied to the abutting position by the developing device of the black image forming unit, is controlled in accordance with the detected amount of supplied toner. Specifically, the supply of abrasive particles to the cleaning member is facilitated, or the abrasive particles that are deposited at the abutting position between the cleaning member and the photosensitive drum are removed. Meanwhile, this control is performed by the control device (controller) illustrated in FIG. 2.

In detail, first, when the number of copies reaches a predetermined number (here, 500) after copy starts, a value of T_total is calculated from the operating times of the yellow, magenta, cyan, and black supply screws at the time of 500 copies that are stored in the memory. T_total is a value that is calculated by the following Expression (1).

$$T_total = T_bk + \alpha \times (T_y + T_m + T_c) \qquad \text{Expression (1)}$$

In Expression (1), T_bk is the operating time of a black supply screw at the time of 500 copies. Likewise, T_y is the operating time of a yellow supply screw at the time of 500 copies, T_m is the operating time of a magenta supply screw at the time of 500 copies, and T_c is the operating time of a cyan supply screw at the time of 500 copies. Further, $\alpha$ is a correction coefficient (here, 0.2).

The correction coefficient $\alpha$ of Expression (1) is a coefficient that is obtained by experiments from a relationship between the retransfer level of the black image forming unit of the image forming apparatus of this embodiment and the amount of abrasive particles, which are attached to the black cleaning member, decreased with respect to the amount of retransfer toner. That is, the correction coefficient is appropriately set in consideration of the capacity of a black developer for abrasive particles, a retransfer level, the structure of the cleaning device, and the like, and is not limited to the above-mentioned value.

The amount of abrasive particles or toner, which is supplied by the developing device, is controlled in accordance with the value T_total that is calculated per a predetermined number of copies described. That is, there is performed an operation for facilitating the supply of abrasive particles to the cleaning device, or an operation for removing abrasive particles that are deposited at the abutting position between the cleaning member and the photosensitive drum.

Figure 4:
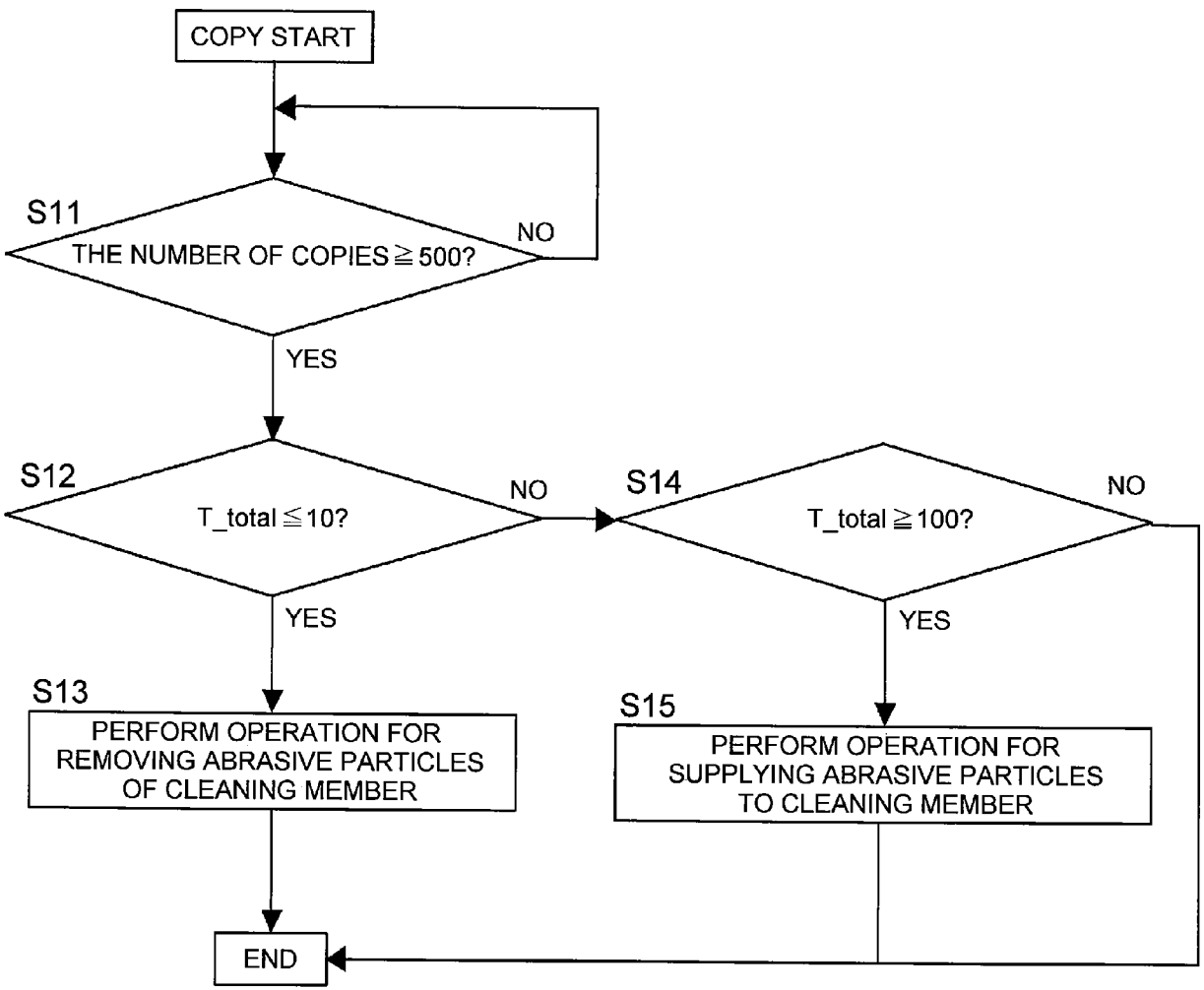
FIG. 4 is a flowchart illustrating a sequence of an operation for facilitating the supply of abrasive particles to a cleaning device that is based on the amount of supplied toner, and a sequence of an operation for removing abrasive particles from the cleaning device.
Figure 5A:
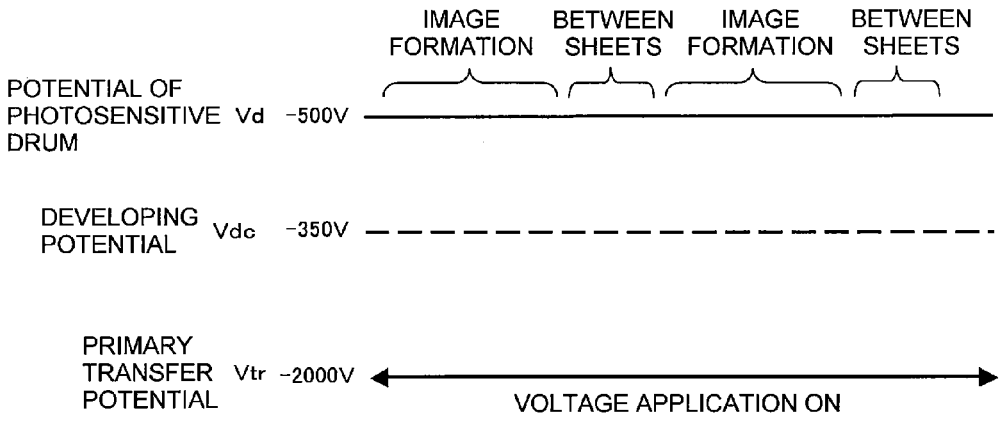
FIGS. 5A and 5B are timing diagrams illustrating an operation for removing abrasive particles from the cleaning device.
Figure 5B:
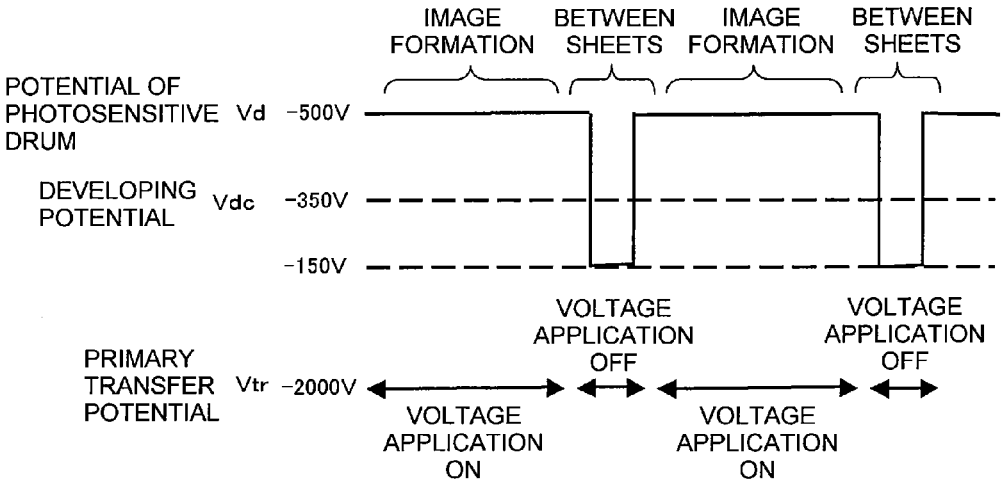

First, the formation of a full-color image will be described. In FIG. 4, when the number of copies reaches a predetermined number (here, 500) (Step S11) after copy starts, the value T_total corresponding to the time of 500 copies, which is stored in the memory, is calculated by Expression (1). That is, the amount of abrasive particles, which are supplied to the abutting position between the cleaning member and the photosensitive drum, is calculated. Further, it is determined whether the value T_total, which is calculated by Expression (1) at the time of 500 copies, satisfies "T_total≦10" (Step S12). Here, if "T_total≦10" is satisfied, it is determined that the amount of toner used in the image forming units provided on the upstream side is smaller than a predetermined amount of toner and the abrasive particles, of which the amount is larger than a predetermined amount, in the developing device of the black image forming unit are supplied to the cleaning member. Then, a process proceeds to Step S13. Furthermore, in order to remove the abrasive particles that are attached to the cleaning member too much, as illustrated in FIG. 5, a predetermined toner image is formed in a non-image area (between sheets) on the photosensitive drum of the black image forming unit that is continuously performing copying. Here, a toner image having a predetermined length (here, a solid black transverse band-shaped image having dimensions of 290 mm×15 mm) is formed in the non-image area, which corresponds to a space between recording materials to be conveyed, on the photosensitive drum of the black image forming unit. As described above, a predetermined toner image is formed in the non-image area on the photosensitive drum of the black image forming unit at a timing other than image formation. Further, while being not transferred to the intermediate transfer belt by shutting off a transfer bias, the toner image formed on the photosensitive drum reaches the abutting position between the cleaning member and the photosensitive drum. Accordingly, abrasive particles collected on the cleaning member are attached to toner, and the abrasive particles are removed from the cleaning member together with the toner (Step S13).

Figure 6A:
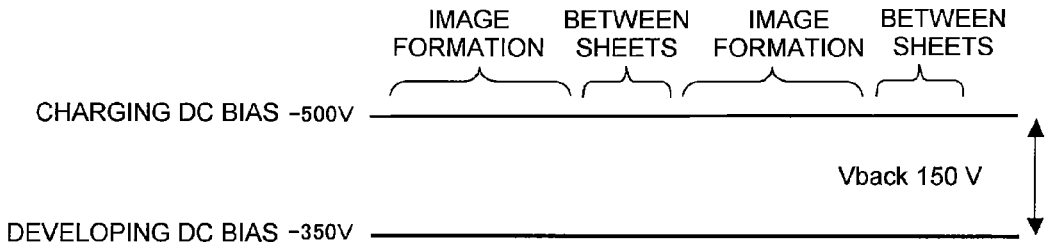
FIGS. 6A and 6B are timing diagrams illustrating an operation for facilitating the supply of abrasive particles to the cleaning device.
Figure 6B:
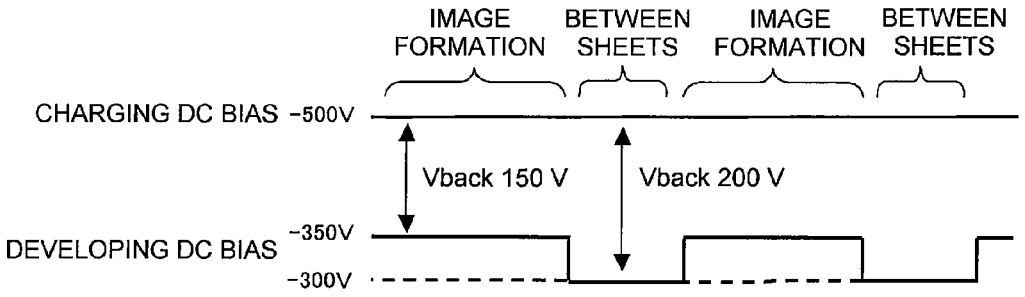

Meanwhile, if the calculated value T_total corresponding to the time of 500 copies, which is stored in the memory, does not satisfy "T_total≦10" when the number of copies reaches 500, the process proceeds to Step S14 and it is determined whether the calculated value T_total satisfies "T_total≦100". Here, if "T_total≦100" is satisfied, it is determined that the amount of toner used in the image forming units provided on the upstream side is larger than a predetermined amount of toner and the amount of abrasive particles attached to the cleaning member of the black image forming unit is lacking. Then, the process proceeds to Step S15. Further, in order to facilitate the supply of abrasive particles to the cleaning member, as illustrated in FIG. 6, the fog removing bias (Vback) is set to be higher than a fog removing bias of the normal image formation, which is a reference, in the non-image area (between sheets) on the photosensitive drum of the black image forming unit that is continuously performing copying. Here, the fog removing bias (Vback) is increased from 150 V to 200 V. Accordingly, in comparison with when the amount of toner used in the image forming units provided on the upstream side of the black image forming unit is smaller than a predetermined amount of toner, the amount of abrasive particles supplied by the developing device is large and the supply of abrasive particles to the cleaning member is facilitated (Step S15).

As described above, the amount of abrasive particles attached to the cleaning member of the black image forming unit is determined on the basis of the information about the amount of all kinds of (yellow, magenta, cyan, and black) toner supplied per a predetermined number of copies, and is to be maintained constant. As a result, it may be possible to suppress the instability of the amount of abrasive particles (which are supplied to the cleaning member of the second image forming unit) caused by the developer that is retransferred from the first image forming unit. Therefore, it may be possible to provide an image forming apparatus that does not generate image defects such as image stripes and image deletion.

Meanwhile, when a black (monochromatic) image is formed, as described above, the photosensitive drum of the unit, which does not form an image, is idled while being abutted against the transfer device as during the normal formation of an image. For this reason, retransfer toner is not generated during the formation of a black (monochromatic) image. Accordingly, in accordance with the information about the amount of toner supplied to the black image forming unit, abrasive particles are supplied to the cleaning device or the abrasive particles collected on the cleaning device are removed. This will be described in detail below with reference to FIGS. 4, 5, and 6.

Here, the formation of a black (monochromatic) image will be described. In FIG. 4, when the number of copies reaches a predetermined number (here, 500) (Step S11) after copy starts, the value T_total corresponding to the time of 500 copies, which is stored in the memory, is calculated by Expression (1). That is, the amount of abrasive particles, which are supplied to the cleaning portion, is calculated. Since a black (monochromatic) image is formed in this case, an integrated value T_total is the operating time of the only black supply screw. Further, it is determined whether the integrated value T_total of the operating time of the black supply screw corresponding to the time of 500 copies satisfies "T_total≦10" (Step S12). Here, if "T_total≦10" is satisfied, it is determined that the abrasive particles, of which the amount is larger than a predetermined amount, in the developing device are supplied to the cleaning member. Then, a process proceeds to Step S13. Furthermore, in order to remove the abrasive particles that are attached to the cleaning member too much, as illustrated in FIG. 5, a predetermined toner image is formed in the non-image area (between sheets) on the photosensitive drum of the black image forming unit that is continuously performing copying. Here, a toner image having a predetermined length (here, a solid black transverse band-shaped image having dimensions of 290 mm×15 mm) is formed in the non-image area, which corresponds to a space between recording materials to be conveyed, on the photosensitive drum of the black image forming unit. As described above, a predetermined toner image is formed in the non-image area on the photosensitive drum of the black image forming unit at a timing other than image formation. Further, while being not transferred to the intermediate transfer belt by shutting off a transfer bias, the toner image formed on the photosensitive drum reaches the abutting position between the cleaning member and the photosensitive drum. Accordingly, abrasive particles collected on the cleaning member are attached to toner, and the abrasive particles are removed from the cleaning member together with the toner (Step S13).

Meanwhile, if the calculated value T_total corresponding to the time of 500 copies, which is stored in the memory, does not satisfy "T_total≦10" when the number of copies reaches 500, the process proceeds to Step S14 and it is determined whether the calculated value T_total satisfies "T_total≦100". Here, if "T_total≦100" is satisfied, it is determined that the amount of abrasive particles attached to the cleaning member is lacking. Then, the process proceeds to Step S15. Further, in order to facilitate the supply of abrasive particles to the cleaning member, as illustrated in FIG. 6, the fog removing electric potential (Vback) is increased from 150 V to 200 V in the non-image area (between sheets) on the photosensitive drum of the black image forming unit that is continuously performing copying. Accordingly, the amount of abrasive particles supplied by the developing device is large and the supply of abrasive particles to the cleaning member is facilitated (Step S15).

Meanwhile, in Step S15 of this embodiment, the amount of supplied abrasive particles has been controlled on the basis of T_total. However, if the amount T_bk of toner formed by the black image forming unit is considered as a fixed value, it may be considered that the following control is performed.

That is, if the sum (T_y+T_m+T_c) of the amount of toner, which is formed by the image forming units provided on the upstream side of the black image forming unit, exceeds a predetermined upper limit (100−T_bk)/α, the controller controls the amount of supplied abrasive particles so that the amount of supplied abrasive particles is increased.

In this case, the controller may change the predetermined upper limit (100−T_bk)/α to a small value. The predetermined upper limit is a threshold value where abrasive particles are further applied to the black image forming unit by as much as the amount T_bk of toner that is formed by the black image forming unit per a predetermined number of formed images. Likewise, if the sum (T_y+T_m+T_c) of the amount of toner, which is formed by the image forming, units provided on the upstream side of the black image forming unit, exceeds a predetermined lower limit (10−T_bk)/α, the controller controls the amount of toner so that so that the amount of toner supplied to the abutting position is increased.

When a black (monochromatic) image is formed as described above, the amount of abrasive particles attached to the cleaning member of the black image forming unit is determined on the basis of the information about the amount of only black toner supplied per a predetermined number of copies and is to be maintained constant. As a result, it may be possible to suppress the instability of the amount of abrasive particles that are supplied to the cleaning member of the second image forming unit. Therefore, it may be possible to provide an image forming apparatus that does not generate image defects such as image stripes and image deletion.

Meanwhile, in this embodiment, an operation for supplying/removing abrasive particles has been performed between sheets (in the non-image area on the photosensitive drum). However, the invention is not limited thereto. For example, as long as the operation is performed at a timing other than image formation, the operation for supplying/removing abrasive particles may be performed during the pre-rotation at the start of a copy job, during the post-rotation after the completion of a copy job, or during the pause of an image forming operation in a copy job.

Further, in this embodiment, it has been determined whether an operation for supplying/removing abrasive particles is performed per a predetermined number of copies. However, the invention is not limited thereto. For example, in case of each of predetermined conditions, the amount of abrasive particles deposited on the cleaning member is determined from the integrated result of the amount of supplied toner per the completion of each copy job and an operation for supplying/removing abrasive particles may then be performed as needed.

Second Embodiment

A second embodiment will be described below. Meanwhile, since an image forming process of this embodiment is substantially the same as the image forming process of the above-mentioned first embodiment, repeated description will be appropriately omitted.

As described above, if the amount of abrasive particles attached to the cleaning member is lacking, the followings are performed in the first embodiment in order to facilitate the supply of abrasive particles to the cleaning member. That is, the fog removing electric potential (Vback) is increased from 150 V of the normal image formation to 200 V in the non-image area (between sheets) on the photosensitive drum.

In this embodiment, in addition to this, in order to further facilitate the supply of the abrasive particles to the cleaning member, a peak-to-peak voltage of the developing bias is increased from 1.8 kVpp of the normal image formation to 2.2 kVpp in the non-image area on the photosensitive drum. This will be described in detail below with reference to FIGS. 4, 5, 6, and 7.

First, the formation of a full-color image will be described. In FIG. 4, when the number of copies reaches a predetermined number (here, 500) (Step S11) after copy starts, the value T_total corresponding to the time of 500 copies, which is stored in the memory, is calculated by Expression (1). That is, the amount of abrasive particles, which are supplied to the abutting position between the cleaning member and the photosensitive drum, is calculated. Further, it is determined whether the value T_total, which is calculated by Expression (1) at the time of 500 copies, satisfies "T_total≦10" (Step S12). Here, if "T_total≦10" is satisfied, it is determined that the amount of toner used in the image forming units provided on the upstream side is smaller than a predetermined amount of toner and the abrasive particles, of which the amount is larger than a predetermined amount, in the developing device of the black image forming unit are supplied to the cleaning member. Then, a process proceeds to Step S13. Furthermore, in order to remove the abrasive particles that are attached to the cleaning member too much, as illustrated in FIG. 5, a predetermined toner image is formed in the non-image area (between sheets) on the photosensitive drum of the black image forming unit that is continuously performing copying. Here, a toner image having a predetermined length (here, a solid black transverse band-shaped image having dimensions of 290 mm×15 mm) is formed in the non-image area, which corresponds to a space between recording materials to be conveyed, on the photosensitive drum of the black image forming unit. As described above, a predetermined toner image is formed in the non-image area on the photosensitive drum of the black image forming unit at a timing other than image formation. Further, while being not transferred to the intermediate transfer belt by shutting off a transfer bias, the toner image formed on the photosensitive drum reaches the abutting position between the cleaning member and the photosensitive drum. Accordingly, abrasive particles collected on the cleaning member are attached to toner, and the abrasive particles are removed from the cleaning member together with the toner (Step S13).

Figure 7A:
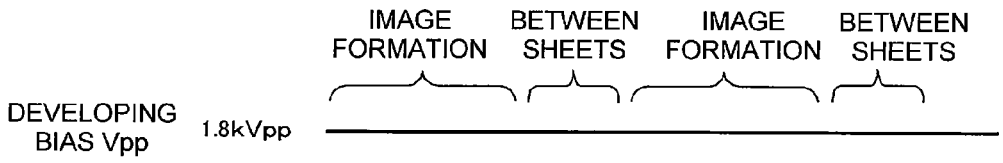
FIGS. 7A and 7B are timing diagrams illustrating an operation for further facilitating the supply of abrasive particles to the cleaning device.
Figure 7B:
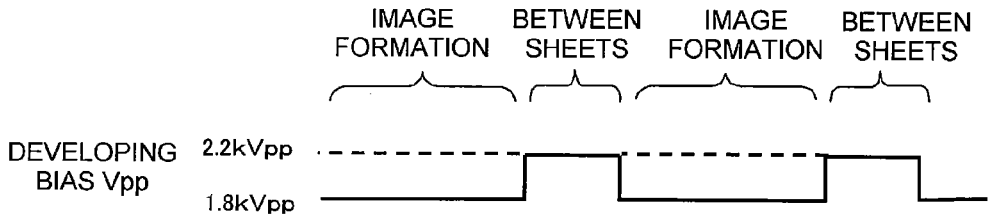

Meanwhile, if the calculated value T_total corresponding to the time of 500 copies, which is stored in the memory, does not satisfy "T_total≦10" when the number of copies reaches 500, the process proceeds to Step S14 and it is determined whether the calculated value T_total satisfies "T_total≧100". Here, if "T_total≧100" is satisfied, it is determined that the amount of toner used in the image forming units provided on the upstream side is larger than a predetermined amount of toner and the amount of abrasive particles attached to the cleaning member of the black image forming unit is lacking. Then, the process proceeds to Step S15. Further, in order to facilitate the supply of abrasive particles to the cleaning member, as illustrated in FIG. 6, the fog removing electric potential (Vback) is increased from 150 V to 200 V in the non-image area (between sheets) on the photosensitive drum of the black image forming unit that is continuously performing copying. Furthermore, as illustrated in FIG. 7, a peak-to-peak voltage of the developing bias is increased from 1.8 kVpp of the normal image formation to 2.2 kVpp in the non-image area (between sheets) on the photosensitive drum. Accordingly, in comparison with when the amount of toner used in the image forming units provided on the upstream side of the black image forming unit is smaller than a predetermined amount of toner, the supply of abrasive particles to the abutting position between the cleaning member and the photosensitive drum is further facilitated (Step S15).

The formation of a black (monochromatic) image will be described below. In FIG. 4, when the number of copies reaches a predetermined number (here, 500) (Step S11) after copy starts, the value T_total corresponding to the time of 500 copies, which is stored in the memory, is calculated by Expression (1). That is, the amount of abrasive particles, which are supplied to the cleaning portion, is calculated. Since a black (monochromatic) image is formed in this case, an integrated value T_total is the operating time of the only black supply screw. Further, it is determined whether the integrated value T_total of the operating time of the black supply screw corresponding to the time of 500 copies satisfies "T_total≦10" (Step S12). Here, if "T_total≦10" is satisfied, it is determined that the abrasive particles, of which the amount is larger than a predetermined amount, in the developing device are supplied to the cleaning member. Then, a process proceeds to Step S13. Furthermore, in order to remove the abrasive particles that are attached to the cleaning member too much, as illustrated in FIG. 5, a predetermined toner image is formed in the non-image area (between sheets) on the photosensitive drum of the black image forming unit that is continuously performing copying. Here, a toner image having a predetermined length (here, a solid black transverse band-shaped image having dimensions of 290 mm×15 mm) is formed in the non-image area, which corresponds to a space between recording materials to be conveyed, on the photosensitive drum of the black image forming unit. As described above, a predetermined toner image is formed in the non-image area on the photosensitive drum of the black image forming unit at a timing other than image formation. Further, while being not transferred to the intermediate transfer belt by shutting off a transfer bias, the toner image formed on the photosensitive drum reaches the abutting position between the cleaning member and the photosensitive drum. Accordingly, abrasive particles collected on the cleaning member are attached to toner, and the abrasive particles are removed from the cleaning member together with the toner (Step S13).

Meanwhile, if the calculated value T_total corresponding to the time of 500 copies, which is stored in the memory, does not satisfy "T_total≦10" when the number of copies reaches 500, the process proceeds to Step S14 and it is determined whether the calculated value T_total satisfies "T_total≧100". Here, if "T_total≧100" is satisfied, it is determined that the amount of abrasive particles attached to the cleaning member is lacking. Then, the process proceeds to Step S15. Further, in order to facilitate the supply of abrasive particles to the cleaning member, as illustrated in FIG. 6, the fog removing electric potential (Vback) is increased from 150 V to 200 V in the non-image area (between sheets) on the photosensitive drum of the black image forming unit that is continuously performing copying. Furthermore, as illustrated in FIG. 7, a peak-to-peak voltage of the developing bias is increased from 1.8 kVpp of the normal image formation to 2.2 kVpp in the non-image area on the photosensitive drum. Accordingly, the amount of abrasive particles supplied by the developing device is large and the supply of abrasive particles to the cleaning member is facilitated (Step S15).

As described above in this embodiment, when the amount of abrasive particles attached to the cleaning member is lacking, the fog removing electric potential (Vback) is increased from 150 V to 200 V in the non-image area (between sheets) in order to further facilitate the supply of the abrasive particles from the developing device. Further, in addition to this, a peak-to-peak voltage of the developing bias is increased from 1.8 kVpp 2.2 kVpp in the non-image area. As a result, it may be possible to further suppress the instability of the amount of abrasive particles (which are supplied to the cleaning member of the second image forming unit) caused by the developer that is retransferred from the first image forming unit. Therefore, it may be possible to provide an image forming apparatus that does not generate image defects such as image stripes and image deletion.

Third Embodiment

A third embodiment will be described below. Meanwhile, since an image forming process of this embodiment is substantially the same as the image forming process of the above-mentioned first and second embodiments, repeated description will be appropriately omitted.

In the first and second embodiments, it has been determined whether an operation for supplying/removing abrasive particles to/from the cleaning member is performed, on the basis of the information about the amount of supplied toner per a predetermined number of copies.

In this embodiment, an average image duty for every job is calculated from an image signal that is obtained after the start of a copy job, and it has been determined whether an operation for supplying/removing abrasive particles is performed, on the basis of the calculation result.

The image forming apparatus according to this embodiment employs a so-called video count system that can estimate the consumption of toner from a video count number of the image concentration of image signals that read out by a CCD and the like. That is, the level of an output signal of an image signal processing circuit is counted for every pixel, and the count number is integrated by the number of pixels corresponding to the paper size of a document, so that the video count number T per sheet of document is obtained. For example, the maximum video count number T of a sheet of A4-size paper is 3884×106 in 400 dpi and 256 gradations. An average image duty (average image ratio) J per job is calculated from the integration of the video count number and the number of copies.

Further, here, the amount of supplied toner or abrasive particles is controlled by using not only the information about the average image duty of the black image forming unit but also the information about the average image duty of the image forming units that are provided on the upstream side of the black image forming unit. This will be described in detail below with reference to FIGS. 5, 6, and 8.

Here, as described above, an average image ratio (average image duty) for every job, which is calculated from an image signal obtained after the start of a copy job, has been exemplified as the information about an image ratio that is based on the image signal. However, the information is not limited thereto. The average image duty is stored in the memory as a storage portion. The structure where the memory is provided in each of the image forming units has been exemplified here, but the number of memories is not limited thereto. For example, the information about a plurality of image forming units may be stored in one memory.

In this embodiment, a stable amount of abrasive particles is always attached to the cleaning device as described below.

Specifically, the average image duty of the image forming units, which are provided on the upstream side of the black image forming unit in the moving direction of the intermediate transfer belt, is detected in addition to the average image duty of the black image forming unit. Further, the amount of toner or abrasive particles supplied to the abutting position between the cleaning member and the photosensitive drum is controlled in accordance with the detection result. Specifically, the supply of abrasive particles to the cleaning member is facilitated, or the abrasive particles that are deposited at the abutting position between the cleaning member and the photosensitive drum are removed. Meanwhile, this control is performed by the control device (controller) illustrated in FIG. 2.

In detail, first, when the number of copies reaches a predetermined number (here, 500) after copy starts, the value J_total corresponding to the time of 500 copies, which is stored in the memory, is calculated from the average image duties of the yellow, magenta, cyan, and black image forming units. J_total is a value that is calculated by the following Expression (2).

$$J_total = J_bk + \alpha x(J_y + J_m + J_c) \quad \text{Expression (2)}$$

In Expression (2), J_bk is the average image duty of the black image forming unit at the time of 500 copies. Likewise, J_y is the average image duty of the yellow image forming unit at the time of 500 copies, J_m is the average image duty of the magenta image forming unit at the time of 500 copies, and J_c is the average image duty of the cyan image forming unit at the time of 500 copies. Further, $\alpha$ is a correction coefficient (here, 0.2).

As in Expression (1), the correction coefficient $\alpha$ of Expression (2) is a coefficient that is obtained by experiments from a relationship between the retransfer level of the black image forming unit of the image forming apparatus of this embodiment and the amount of abrasive particles, which are attached to the cleaning member of the black image forming unit, decreased with respect to the amount of retransfer toner. That is, the correction coefficient is appropriately set in consideration of the capacity of a black developer for abrasive particles, a retransfer level, the structure of the cleaning device, and the like, and is not limited to the above-mentioned value.

The amount of abrasive particles or toner, which is supplied by the developing device, is controlled in accordance with the value J_total that is calculated per a predetermined number of copies. That is, there is performed an operation for facilitating the supply of abrasive particles to the cleaning device, or an operation for removing abrasive particles that are deposited at the abutting position between the cleaning member and the photosensitive drum.

Figure 8:
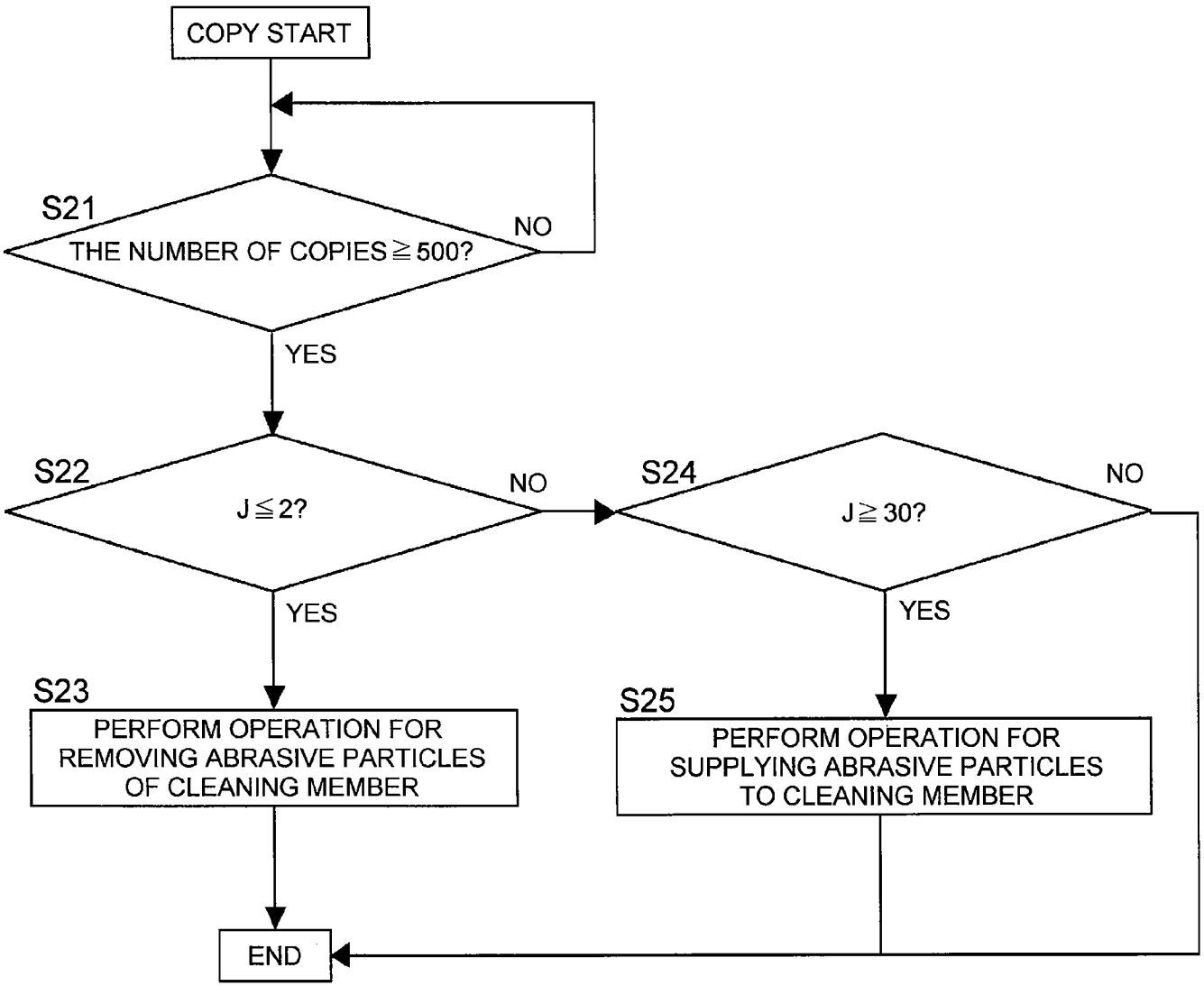
FIG. 8 is a flowchart illustrating a sequence of an operation for facilitating the supply of abrasive particles to the cleaning device that is based on an image ratio, and a sequence of an operation for removing abrasive particles from the cleaning device.

First, the formation of a full-color image will be described. In FIG. 8, when the number of copies reaches a predetermined number (here, 500) (Step S21) after copy starts, the value J_total corresponding to the time of 500 copies, which is stored in the memory, is calculated by Expression (2). That is, the amount of abrasive particles, which are supplied to the abutting position between the cleaning member and the photosensitive drum, is calculated. Further, it is determined whether the value J_total, which is calculated by Expression (2) at the time of 500 copies, satisfies "J_total≦2" (Step S22). Here, if "J_total≦2" is satisfied, it is determined that the amount of toner used in the image forming units provided on the upstream side is smaller than a predetermined amount of toner and the abrasive particles, of which the amount is larger than a predetermined amount, in the developing device of the black image forming unit are supplied to the cleaning member. Then, a process proceeds to Step S23. Furthermore, in order to remove the abrasive particles that are attached to the cleaning member too much, as illustrated in FIG. 5, a predetermined toner image is formed in the non-image area (between sheets) on the photosensitive drum of the black image forming unit that is continuously performing copying. Here, a toner image having a predetermined length (here, a solid black transverse band-shaped image having dimensions of 290 mm×15 mm) is formed in the non-image area, which corresponds to a space between recording materials to be conveyed, on the photosensitive drum of the black image forming unit. As described above, a predetermined toner image is formed in the non-image area on the photosensitive drum of the black image forming unit at a timing other than image formation. Further, while being not transferred to the intermediate transfer belt by shutting off a transfer bias, the toner image formed on the photosensitive drum reaches the abutting position between the cleaning member and the photosensitive drum. Accordingly, abrasive particles collected on the cleaning member are attached to toner, and the abrasive particles are removed from the cleaning member together with the toner (Step S23).

Meanwhile, if the calculated value J_total corresponding to the time of 500 copies, which is stored in the memory, does not satisfy "J_total≦2" when the number of copies reaches 500, the process proceeds to Step S24 and it is determined whether the calculated value J_total satisfies "J_total≧30". Here, if "J_total≧30" is satisfied, it is determined that the amount of toner used in the image forming units provided on the upstream side is larger than a predetermined amount of toner and the amount of abrasive particles attached to the cleaning member of the black image forming unit is lacking. Then, the process proceeds to Step S25. Further, in order to facilitate the supply of abrasive particles to the cleaning member, as illustrated in FIG. 6, the fog removing electric potential (Vback) is increased from 150 V to 200 V in the non-image area (between sheets) on the photosensitive drum of the black image forming unit that is continuously performing copying. Accordingly, in comparison with when the amount of toner used in the image forming units provided on the upstream side of the black image forming unit is smaller than a predetermined amount of toner, the amount of abrasive particles supplied by the developing device is large and the supply of abrasive particles to the cleaning member is facilitated (Step S25).

As described above, the amount of abrasive particles attached to the cleaning member of the black image forming unit is determined on the basis of the information about the average image duties of all (yellow, magenta, cyan, and black) image forming units per a predetermined number of copies, and is to be maintained constant. As a result, it may be possible to suppress the instability of the amount of abrasive particles (which are supplied to the cleaning member of the second image forming portion) caused by the developer that is retransferred from the first image forming portion. Therefore, it may be possible to provide an image forming apparatus that does not generate image defects such as image stripes and image deletion.

The formation of a black (monochromatic) image will be described below. In FIG. 8, when the number of copies reaches a predetermined number (here, 500) (Step S21) after copy starts, the value J_total corresponding to the time of 500 copies, which is stored in the memory, is calculated by Expression (2). That is, the amount of abrasive particles, which are supplied to the cleaning portion, is calculated. Since a black (monochromatic) image is formed in this case, an integrated value J_total is the average image duty of the only black image forming unit. Further, it is determined whether the value J_total of the average image duty of the black image forming unit corresponding to the time of 500 copies satisfies "J_total≦10" (Step S22). Here, if "J_total≦10" is satisfied, it is determined that the abrasive particles, of which the amount is larger than a predetermined amount, in the developing device are supplied to the cleaning member. Then, a process proceeds to Step S23. Furthermore, in order to remove the abrasive particles that are attached to the cleaning member too much, as illustrated in FIG. 5, a predetermined toner image is formed in the non-image area (between sheets) on the photosensitive drum of the black image forming unit that is continuously performing copying. Here, a toner image having a predetermined length (here, a solid black transverse band-shaped image having dimensions of 290 mm×15 mm) is formed in the non-image area, which corresponds to a space between recording materials to be conveyed, on the photosensitive drum of the black image forming unit. As described above, a predetermined toner image is formed in the non-image area on the photosensitive drum of the black image forming unit at a timing other than image formation. Further, while being not transferred to the intermediate transfer belt by shutting off a transfer bias, the toner image formed on the photosensitive drum reaches the abutting position between the cleaning member and the photosensitive drum. Accordingly, abrasive particles collected on the cleaning member are attached to toner, and the abrasive particles are removed from the cleaning member together with the toner (Step S23).

Meanwhile, if the calculated value J_total corresponding to the time of 500 copies, which is stored in the memory, does not satisfy "J_total≦2" when the number of copies reaches 500, the process proceeds to Step S24 and it is determined whether the calculated value J_total satisfies "J_total≧30". Here, if "J_total≧30" is satisfied, it is determined that the amount of abrasive particles attached to the cleaning member is lacking. Then, the process proceeds to Step S25. Further, in order to facilitate the supply of abrasive particles to the cleaning member, as illustrated in FIG. 6, the fog removing electric potential (Vback) is increased from 150 V to 200 V in the non-image area (between sheets) on the photosensitive drum of the black image forming unit that is continuously performing copying. Accordingly, the amount of abrasive particles, which are supplied by the developing device, is large and the supply of abrasive particles to the cleaning member is facilitated (Step S25).

An average image duty per one sheet for every job is calculated from an image signal that is obtained after the start of a copy job. Then, the amount of abrasive particles attached to the cleaning member of the black image forming unit is determined on the basis of the calculation result, and is to be maintained constant. As a result, it may be possible to suppress the instability of the amount of abrasive particles that are supplied to the cleaning member of the second image forming unit. Therefore, it may be possible to provide an image forming apparatus that does not generate image defects such as image stripes and image deletion.

Fourth Embodiment

A fourth embodiment will be described below. Meanwhile, since an image forming process of this embodiment is substantially the same as the image forming process of the above-mentioned first to third embodiments, repeated description will be appropriately omitted.

In this embodiment, a photosensitive drum, which uses the above-mentioned photocurable resin (electron beam curable resin), is employed as each of all the yellow, magenta, cyan, and black photosensitive drums. Further, in all of the yellow, magenta, cyan, and black image forming units, 0.2% by weight of abrasive particles is contained in toner. In this embodiment, among the four (yellow (Y), magenta (M), cyan (C), and black (Bk)) image forming units, an arbitrary image forming unit may be considered as a second image forming portion. Furthermore, all image forming units, which are disposed on the upstream side of the second image forming portion, may be considered as a first image forming portion. Specifically, if the magenta (M) image forming unit is considered as a second image forming portion, a first image forming portion is the yellow (Y) image forming unit.

Problems, which occur when a full-color image is formed by the yellow, magenta, cyan, and black image forming units, will be described here.

In this embodiment, for example, when images having a low image ratio (for example, image duty of 2%) are continuously formed several times in all image forming units, many abrasive particles are supplied to the cleaning device 6 of each of the image forming units. Accordingly, all abrasive particles may not be collected by the cleaning device 6 and many abrasive particles are attached to the charging roller 3 and the photosensitive drum 2, so that and image defects are generated due to the unevenness of charge. Further, the surface of the photosensitive drum is excessively abraded, so that the life of the photosensitive drum is shortened.

In particular, since the image ratios of all the image forming units are low in this case, the amount of abrasive particles supplied from the developing device of each of the image forming units is increased. As a result, the amount of abrasive particles, which are retransferred to the image forming units provided on the downstream side in the moving direction of the intermediate transfer belt through the intermediate transfer belt, is increased. Accordingly, the amount of abrasive particles attached to the cleaning device 6 of the image forming unit provided on the downstream side is increased.

Furthermore, images having a normal image ratio (for example, image duty of 5%) are formed in the yellow, magenta, and black image forming units, and a full-color image having a low image ratio (for example, image duty of 1%) is continuously formed in the cyan image forming unit. In this case, even though the amount of abrasive particles supplied to the cleaning member from the black developing device is stable, a part of the abrasive particles generated from the cyan image forming unit are retransferred and supplied to the black cleaning member. As a result, the amount of abrasive particles attached to the black cleaning device 6 is increased.

When a full-color image is formed as described above, there has been a problem in that the retransferred abrasive particles are mixed in each of the black image forming units and the amount of abrasive particles attached to each of the cleaning members is thus increased.

Meanwhile, images having a high image ratio (for example, image duty of 30% or more) are continuously formed several times in all image forming units. In this case, if the image forming units provided on the upstream side do not contain abrasive particles as in the first to third embodiments, the amount of abrasive particles attached to the cleaning member is decreased due to the retransfer toner. However, if the image forming units provided on the upstream side also contain abrasive particles as in this embodiment, retransfer is apt to occur since the polarity of the abrasive particles is the opposite-polarity that is opposite to the polarity of toner. Further, in addition to this, abrasive particles are also attached to the retransfer toner. For this reason, the decrease of the amount of abrasive particles attached to the cleaning member, which is caused by retransfer toner, does not occur.

Further, here, the amount of abrasive particles, which are supplied to the abutting position between the cleaning member and the photosensitive drum, is controlled by using not only the information about the amount of toner supplied to an image forming unit but also the information about the amount of toner supplied to the image forming units that are provided on the upstream side of the image forming unit. This will be described in detail below with reference to FIGS. 5, 6, 9, 10, 11, and 12.

The above-mentioned information about the amount of supplied toner is the amount of toner supplied to the developing device when a predetermined number of images are formed (per a predetermined number of prints). Here, the operating time (time of rotation) of the toner supply screw, which is disposed in the toner hopper and supplies toner to the developing container, is used as the amount of supplied toner. The amount of supplied toner is stored in the memory as a storage portion. The structure where the memory is provided in each of the image forming units has been exemplified here, but the number of memories is not limited thereto. For example, the information about a plurality of image forming units may be stored in one memory.

In this embodiment, not only the amount of toner supplied to an image forming unit but also the amount of toner supplied to the image forming units, which are provided on the upstream side of the image forming unit in the moving direction of the intermediate transfer belt, is detected as described below. Further, the amount of abrasive particles or toner, which is supplied to the abutting position by the developing device of the image forming unit, is controlled in accordance with the amount of toner supplied to each of the units. Specifically, the supply of abrasive particles to the cleaning member is facilitated, or the abrasive particles that are deposited at the abutting position between the cleaning member and the photosensitive drum are removed. Meanwhile, this control is performed by the control device (controller) illustrated in FIG. 2.

The formation of a full-color image will be now described. First, when the number of copies reaches a predetermined number (here, 500) after copy starts, integrated values of the amount of toner supplied to the yellow, magenta, cyan, and black image forming units are calculated at the time of 500 copies that are stored in the memory. The integrated values T_y_total, T_m_total, T_c_total, and T_bk_total are values that are calculated by the following Expressions (3), (4), (5), and (6), respectively.

$$T_y_\text{total}=T_y \quad \text{Expression (3)}$$

$$T_m_\text{total}=T_y+T_m \quad \text{Expression (4)}$$

$$T_c_\text{total}=T_y+T_m+T_c \quad \text{Expression (5)}$$

$$T_bk_\text{total}=T_y+T_m+T_c+T_bk \quad \text{Expression (6)}$$

In Expressions (3), (4), (5), and (6), T_y is the operating time of the yellow supply screw at the time of 500 copies. Likewise, T_m is the operating time of the magenta supply screw at the time of 500 copies, T_c is the operating time of the cyan supply screw at the time of 500 copies, and T_bk is the operating time of the black supply screw at the time of 500 copies.

The amount of abrasive particles or toner, which is supplied by the developing device, is controlled in accordance with the respective calculated values T_y_total, T_m_total, T_c_total, and T_bk_total that are calculated per the above-mentioned predetermined number of copies. That is, there is performed an operation for facilitating the supply of abrasive particles to the cleaning member. Alternatively, there is performed an operation for removing abrasive particles that are deposited at the abutting position between the cleaning member and the photosensitive drum.

Figure 9:
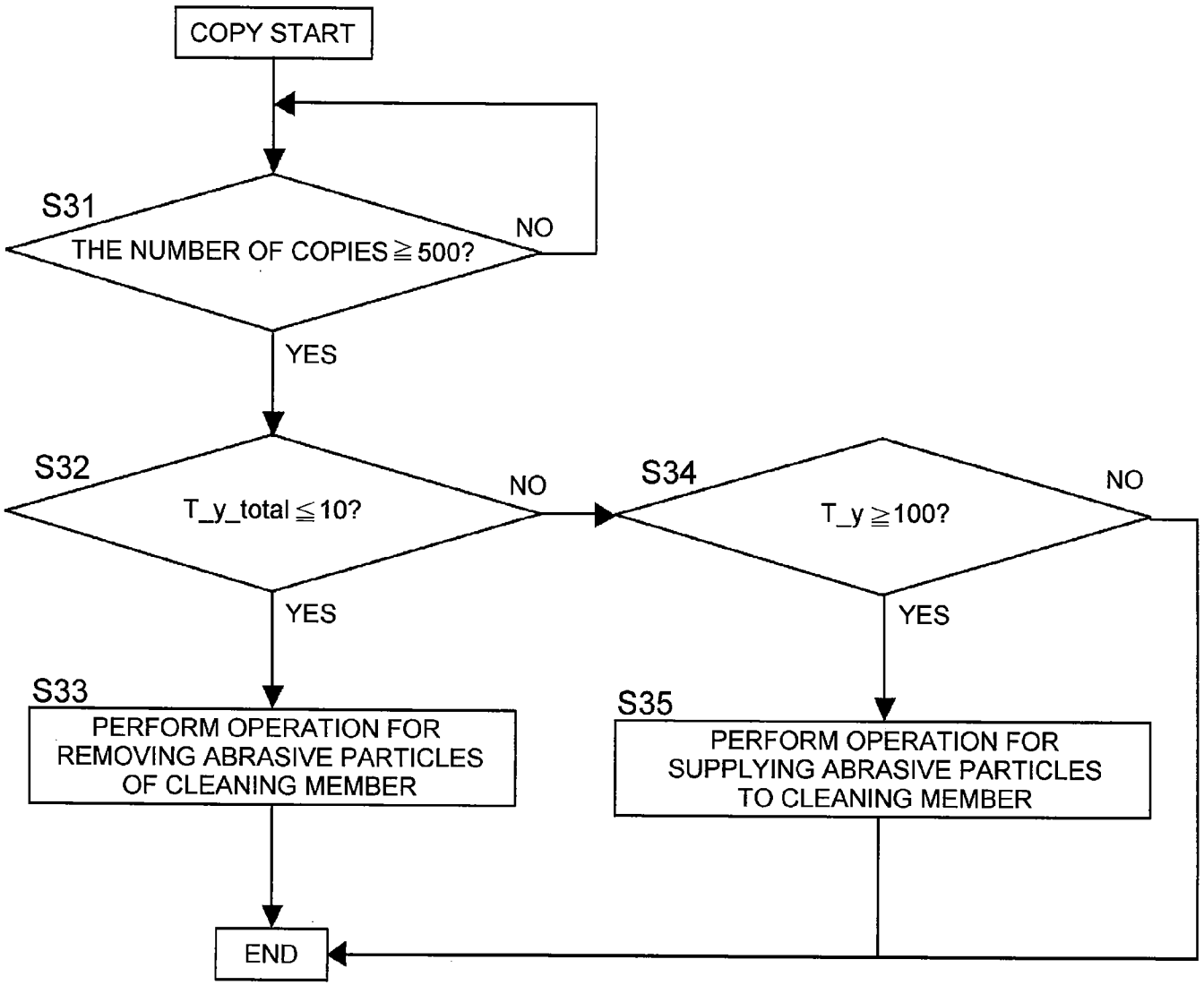
FIG. 9 is a flowchart illustrating a sequence of an operation for facilitating the supply of abrasive particles to a cleaning device of a yellow image forming unit, and a sequence of an operation for removing abrasive particles from the cleaning device.

First, the yellow image forming unit will be described. In FIG. 9, when the number of copies reaches a predetermined number (here, 500) (Step S31) after copy starts, the value T_y_total corresponding to the time of 500 copies, which is stored in the memory, is calculated by Expression (3). That is, the amount of abrasive particles, which are supplied to the abutting position between the cleaning member and the photosensitive drum, is calculated. Further, it is determined whether the value T_y_total, which is calculated by Expression (3) at the time of 500 copies, satisfies "T_y_total≦10" (Step S32). Here, if "T_y_total≦10" is satisfied, it is determined that the abrasive particles, of which the amount is larger than a predetermined amount, in the developing device of the yellow image forming unit are supplied to the cleaning member. Then, a process proceeds to Step S33.

Furthermore, in order to remove the abrasive particles that are attached to the cleaning member too much, as illustrated in FIG. 5, a predetermined toner image is formed in the non-image area (between sheets) on the photosensitive drum of the yellow image forming unit that is continuously performing copying. Here, a toner image having a predetermined length (here, a solid black transverse band-shaped image having dimensions of 290 mm×15 mm) is formed in the non-image area, which corresponds to a space between recording materials to be conveyed, on the photosensitive drum of the yellow image forming unit.

As described above, a predetermined toner image is formed in the non-image area on the photosensitive drum of the yellow image forming unit at a timing other than image formation. Further, while being not transferred to the intermediate transfer belt by shutting off a transfer bias, the toner image formed on the photosensitive drum reaches the abutting position between the cleaning member and the photosensitive drum. Accordingly, abrasive particles collected on the cleaning member are attached to toner, and the abrasive particles are removed from the cleaning member together with the toner (Step S33).

Meanwhile, if the calculated value T_y_total corresponding to the time of 500 copies, which is stored in the memory, does not satisfy "T_y_total≦10" when the number of copies reaches 500, the process proceeds to Step S34. Further, it is determined whether the calculated value T_y_total satisfies "T_y_total≧100". Here, if "T_y_total≧100" is satisfied, it is determined that the amount of abrasive particles attached to the cleaning member is lacking. Then, the process proceeds to Step S35. Further, in order to facilitate the supply of abrasive particles to the cleaning member, as illustrated in FIG. 6, the fog removing electric potential (Vback) is increased from 150 V to 200 V in the non-image area (between sheets) on the photosensitive drum of the yellow image forming unit that is continuously performing copying. Accordingly, the amount of abrasive particles supplied by the developing device is large and the supply of abrasive particles to the cleaning member is facilitated (Step S35).

Figure 10:
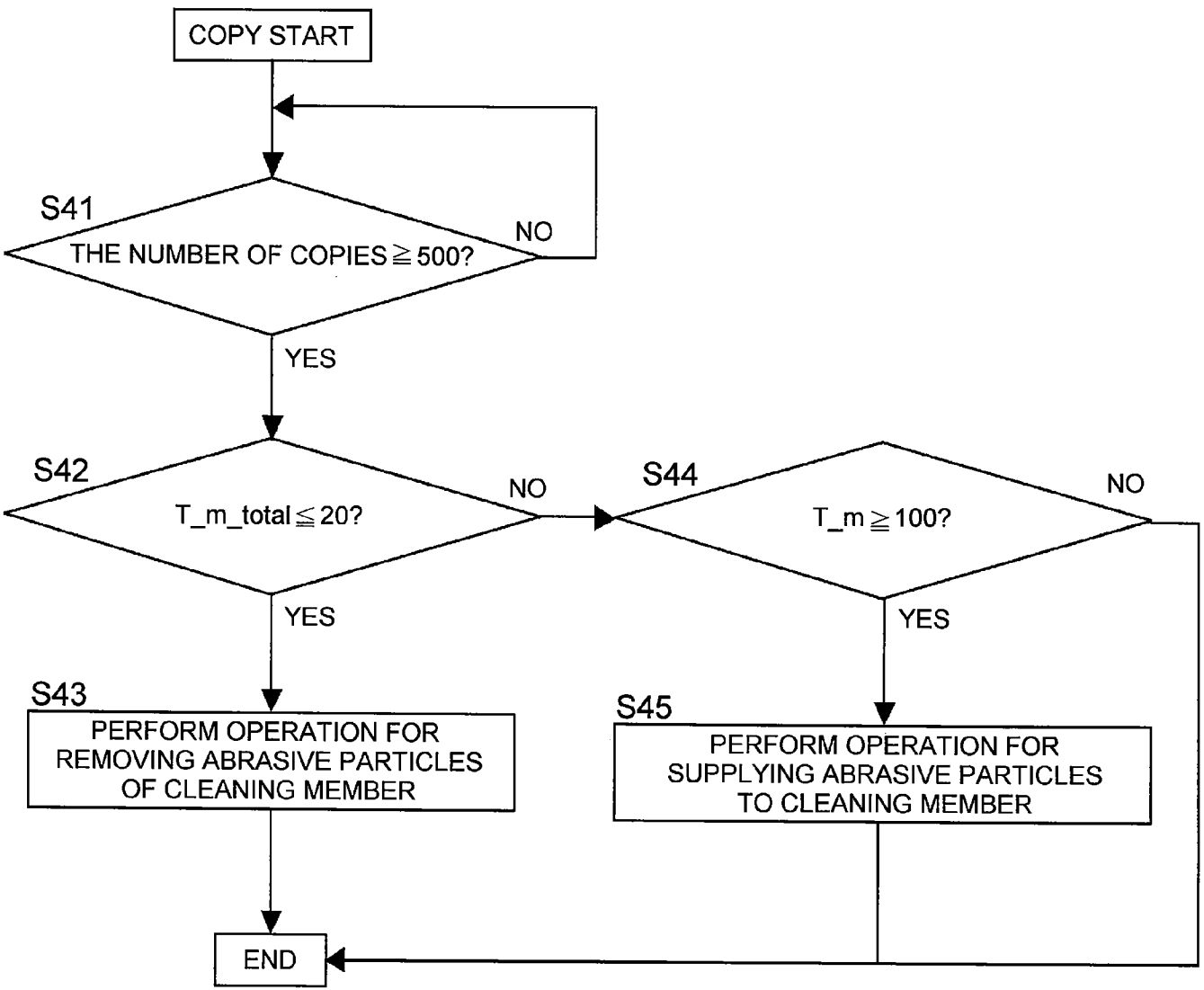
FIG. 10 is a flowchart illustrating a sequence of an operation for facilitating the supply of abrasive particles to a cleaning device of a magenta image forming unit, and a sequence of an operation for removing abrasive particles from the cleaning device.

The magenta image forming unit will be described below. In FIG. 10, when the number of copies reaches a predetermined number (here, 500) (Step S41) after copy starts, the value T_m_total corresponding to the time of 500 copies, which is stored in the memory, is calculated by Expression (4). That is, the amount of abrasive particles, which are supplied to the abutting position between the cleaning member and the photosensitive drum, is calculated. Further, it is determined whether the value T_m_total, which is calculated by Expression (4) at the time of 500 copies, satisfies "T_m_total≦20" (Step S42). Here, if "T_m_total≦20" is satisfied, it is determined that the amount of toner used in the image forming units provided on the upstream side is smaller than a predetermined amount of toner and the abrasive particles, of which the amount is larger than a predetermined amount, in the developing device of the magenta image forming unit are supplied to the cleaning member. Then, a process proceeds to Step S43.

Here, not "T_m_total≦10" but "T_m_total≦20" satisfied and a lower limit of the supply start of the abrasive particles of the magenta station is larger than that of the yellow station. The reason for this is that it is considered that abrasive particles are contained in the retransfer toner, and a threshold value of the supply start of abrasive particles is set to be higher than that of the station provided on the upstream side of the station.

Furthermore, in order to remove the abrasive particles that are attached to the cleaning member too much, as illustrated in FIG. 5, a predetermined toner image is formed in the non-image area (between sheets) on the photosensitive drum of the magenta image forming unit that is continuously performing copying. Here, a toner image having a predetermined length (here, a solid black transverse band-shaped image having dimensions of 290 mm×15 mm) is formed in the non-image area, which corresponds to a space between recording materials to be conveyed, on the photosensitive drum of the magenta image forming unit.

As described above, a predetermined toner image is formed in the non-image area on the photosensitive drum of the magenta image forming unit at a timing other than image formation. Further, while being not transferred to the intermediate transfer belt by shutting off a transfer bias, the toner image formed on the photosensitive drum reaches the abutting position between the cleaning member and the photosensitive drum. Accordingly, abrasive particles collected on the cleaning member are attached to toner, and the abrasive particles are removed from the cleaning member together with the toner (Step S43).

Meanwhile, if the calculated value T_m_total corresponding to the time of 500 copies, which is stored in the memory, does not satisfy "T_m_total≧20" when the number of copies reaches 500, the process proceeds to Step S44 and it is determined whether the calculated value T_m_total satisfies "T_m_total≧100". Here, if "T_m_total≧100" is satisfied, it is determined that the amount of toner used in the image forming unit provided on the upstream side is larger than a predetermined amount of toner and the amount of abrasive particles attached to the cleaning member of the magenta image forming unit is lacking. Then, the process proceeds to Step S45. Further, in order to facilitate the supply of abrasive particles to the cleaning member, as illustrated in FIG. 6, the fog removing electric potential (Vback) is increased from 150 V to 200 V in the non-image area (between sheets) on the photosensitive drum of the magenta image forming unit that is continuously performing copying. Accordingly, in comparison with when the amount of toner used in the image forming unit provided on the upstream side of the magenta image forming unit is smaller than a predetermined amount of toner, the amount of abrasive particles supplied by the developing device is large and the supply of abrasive particles to the cleaning member is facilitated (Step S45).

Figure 11:
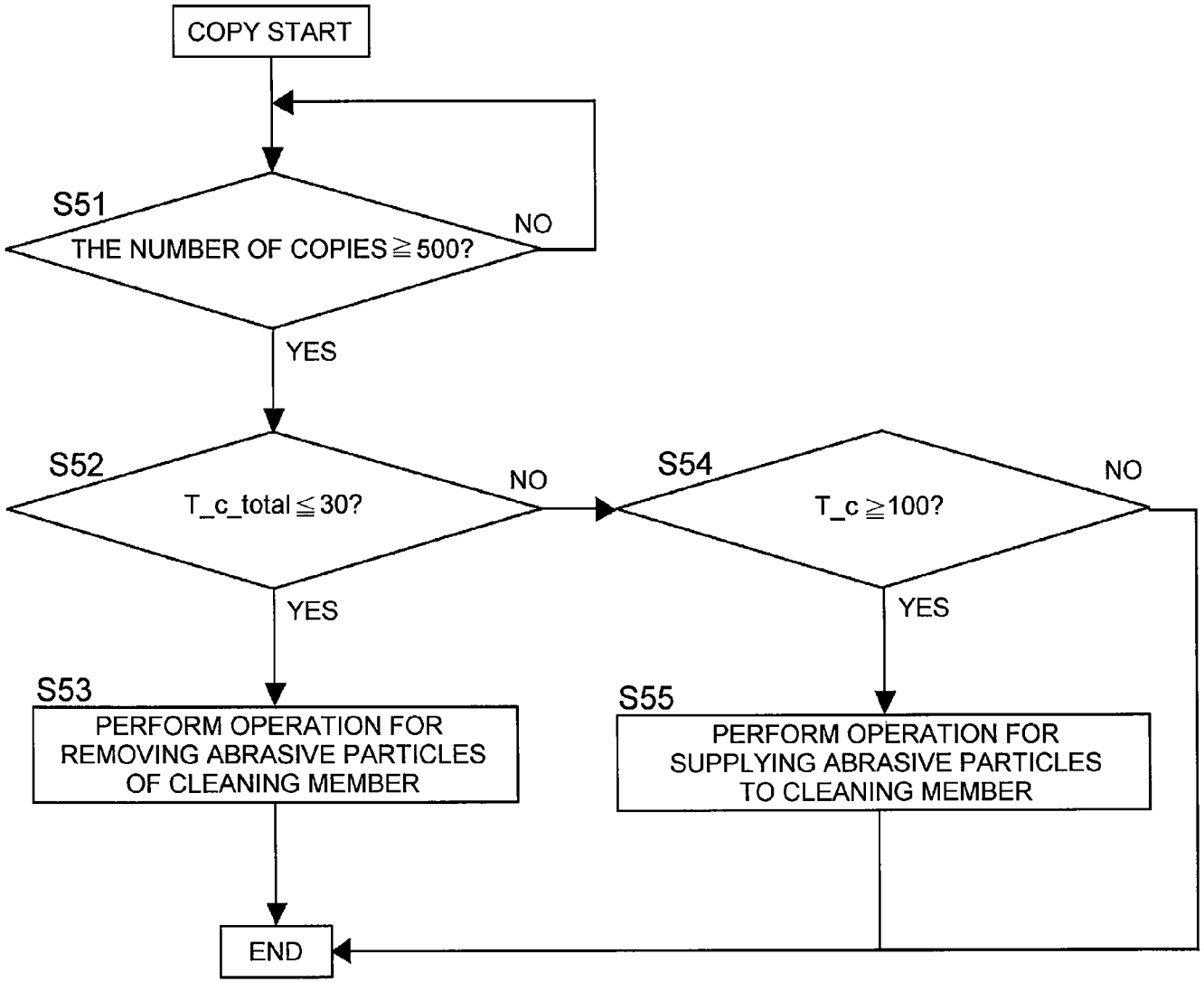
FIG. 11 is a flowchart illustrating a sequence of an operation for facilitating the supply of abrasive particles to a cleaning device of a cyan image forming unit, and a sequence of an operation for removing abrasive particles from the cleaning device.

The cyan image forming unit will be described below. In FIG. 11, when the number of copies reaches a predetermined number (here, 500) (Step S51) after copy starts, the value T_c_total corresponding to the time of 500 copies, which is stored in the memory, is calculated by Expression (5). That is, the amount of abrasive particles, which are supplied to the abutting position between the cleaning member and the photosensitive drum, is calculated. Further, it is determined whether the calculated value T_c_total, which is calculated by Expression (5) at the time of 500 copies, satisfies "T_c_total≦30" (Step S52).

Here, if "T_c_total≦30" is satisfied, it is determined that the amount of toner used in the image forming units provided on the upstream side is smaller than a predetermined amount of toner and the abrasive particles, of which the amount is larger than a predetermined amount, in the developing device of the cyan image forming unit are supplied to the cleaning member. Then, a process proceeds to Step S53. Furthermore, in order to remove the abrasive particles that are attached to the cleaning member too much, as illustrated in FIG. 5, a predetermined toner image is formed in the non-image area (between sheets) on the photosensitive drum of the cyan image forming unit that is continuously performing copying. Here, a toner image having a predetermined length (here, a solid black transverse band-shaped image having dimensions of 290 mm×15 mm) is formed in the non-image area, which corresponds to a space between recording materials to be conveyed, on the photosensitive drum of the cyan image forming unit.

As described above, a predetermined toner image is formed in the non-image area on the photosensitive drum of the cyan image forming unit at a timing other than image formation. Further, while being not transferred to the intermediate transfer belt by shutting off a transfer bias, the toner image formed on the photosensitive drum reaches the abutting position between the cleaning member and the photosensitive drum. Accordingly, abrasive particles collected on the cleaning member are attached to toner, and the abrasive particles are removed from the cleaning member together with the toner (Step S53).

Meanwhile, if the calculated value T_c_total corresponding to the time of 500 copies, which is stored in the memory, does not satisfy "T_c_total≦30" when the number of copies reaches 500, the process proceeds to Step S54 and it is determined whether the calculated value T_c_total satisfies "T_c_total≧100". Here, if "T_c_total≧100" is satisfied, it is determined that the amount of toner used in the image forming unit provided on the upstream side is larger than a predetermined amount of toner and the amount of abrasive particles attached to the cleaning member of the cyan image forming unit is lacking. Then, the process proceeds to Step S55. Further, in order to facilitate the supply of abrasive particles to the cleaning member, as illustrated in FIG. 6, the fog removing electric potential (Vback) is increased from 150 V to 200 V in the non-image area (between sheets) on the photosensitive drum of the cyan image forming unit that is continuously performing copying. Accordingly, in comparison with when the amount of toner used in the image forming unit provided on the upstream side of the cyan image forming unit is smaller than a predetermined amount of toner, the amount of abrasive particles supplied by the developing device is large and the supply of abrasive particles to the cleaning member is facilitated (Step S55).

Figure 12:
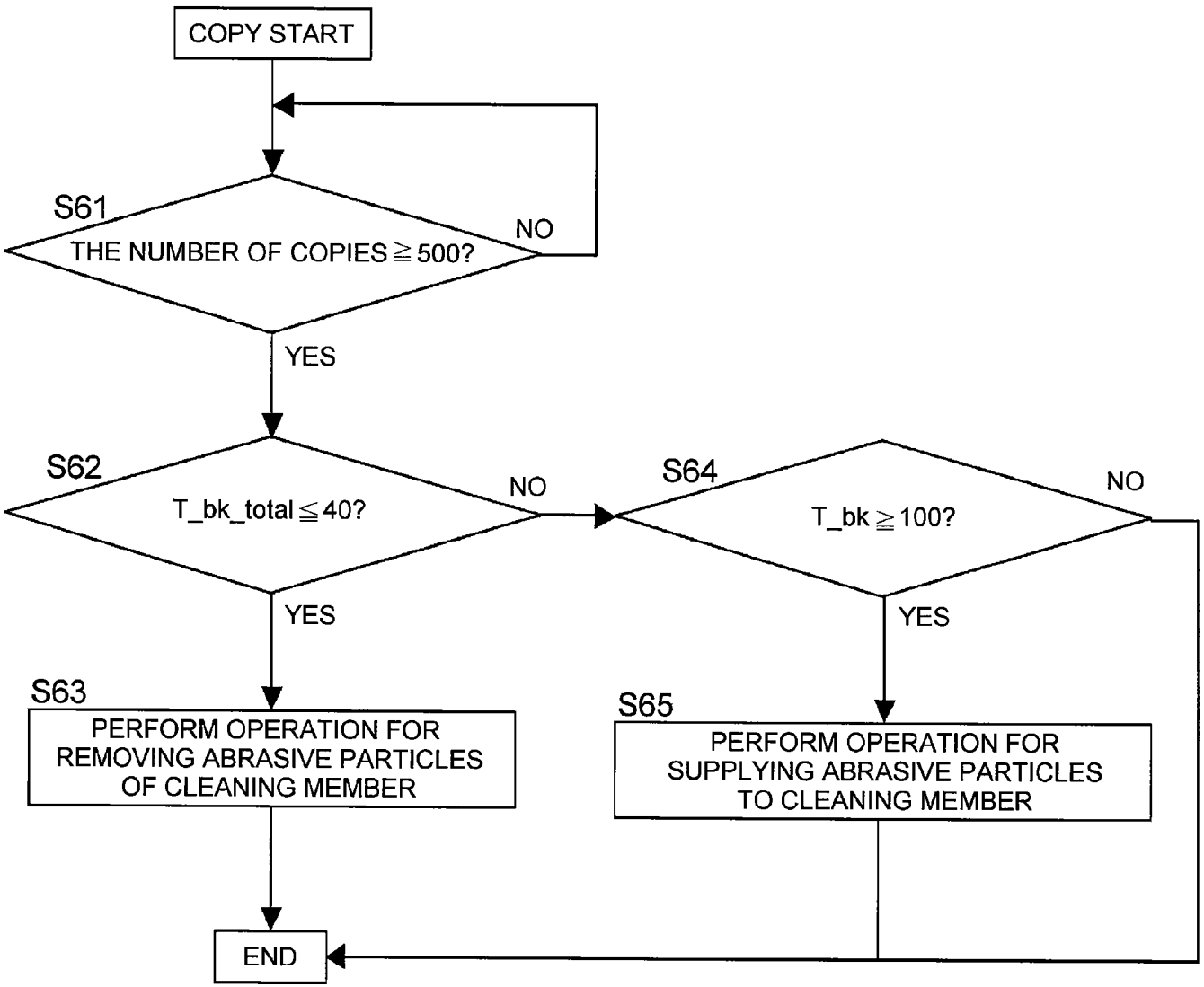
FIG. 12 is a flowchart illustrating a sequence of an operation for facilitating the supply of abrasive particles to a cleaning device of a black image forming unit, and a sequence of an operation for removing abrasive particles from the cleaning device.

The black image forming unit will be described below. In FIG. 12, when the number of copies reaches a predetermined number (here, 500) (Step S61) after copy starts, the value T_bk_total corresponding to the time of 500 copies, which is stored in the memory, is calculated by Expression (6). That is, the amount of abrasive particles, which are supplied to the abutting position between the cleaning member and the photosensitive drum, is calculated. Further, it is determined whether the calculated value T_bk_total, which is calculated by Expression (6) at the time of 500 copies, satisfies "T_bk_total≦40" (Step S62). Here, if "T_bk_total≦40" is satisfied, it is determined that the amount of toner used in the image forming units provided on the upstream side is smaller than a predetermined amount of toner and the abrasive particles, of which the amount is larger than a predetermined amount, in the developing device of the black image forming unit are supplied to the cleaning member. Then, a process proceeds to Step 63. Furthermore, in order to remove the abrasive particles that are attached to the cleaning member too much, as illustrated in FIG. 5, a predetermined toner image is formed in the non-image area (between sheets) on the photosensitive drum of the black image forming unit that is continuously performing copying. Here, a toner image having a predetermined length (here, a solid black transverse band-shaped image having dimensions of 290 mm×15 mm) is formed in the non-image area, which corresponds to a space between recording materials to be conveyed, on the photosensitive drum of the black image forming unit. As described above, a predetermined toner image is formed in the non-image area on the photosensitive drum of the black image forming unit at a timing other than image formation. Further, while being not transferred to the intermediate transfer belt by shutting off a transfer bias, the toner image formed on the photosensitive drum reaches the abutting position between the cleaning member and the photosensitive drum. Accordingly, abrasive particles collected on the cleaning member are attached to toner, and the abrasive particles are removed from the cleaning member together with the toner (Step S63).

Meanwhile, if the calculated value T_bk_total corresponding to the time of 500 copies, which is stored in the memory, does not satisfy "T_bk_total≦40" when the number of copies reaches 500, the process proceeds to Step S64 and it is determined whether the calculated value T_bk_total satisfies "T_bk_total≧100". Here, if "T_bk_total≧100" is satisfied, it is determined that the amount of toner used in the image forming units provided on the upstream side is larger than a predetermined amount of toner and the amount of abrasive particles attached to the cleaning member of the black image forming unit is lacking. Then, the process proceeds to Step S65. Further, in order to facilitate the supply of abrasive particles to the cleaning member, as illustrated in FIG. 6, the fog removing electric potential (Vback) is increased from 150 V to 200 V in the non-image area (between sheets) on the photosensitive drum of the black image forming unit that is continuously performing copying. Accordingly, in comparison with when the amount of toner used in the image forming units provided on the upstream side of the black image forming unit is smaller than a predetermined amount of toner, the amount of abrasive particles supplied by the developing device is large and the supply of abrasive particles to the cleaning member is facilitated (Step S65).

As described above, the amount of abrasive particles attached to the cleaning members of the respective image forming units is controlled on the basis of the information about the amount of toner supplied to the respective image forming units per a predetermined number of prints and the information about the amount of toner supplied to the image forming units provided on their upstream side. As a result, it may be possible to suppress the instability of the amount of abrasive particles (which are supplied to the cleaning member of the second image forming portion) caused by the developer that is retransferred from the first image forming portion. Therefore, it may be possible to provide an image forming apparatus that does not generate image defects such as image stripes and image deletion.

Meanwhile, when a black (monochromatic) image is formed, as in the first embodiment, abrasive particles are supplied to the cleaning device or the abrasive particles collected on the cleaning device are removed in accordance with the information about the amount of toner supplied to the black image forming unit.

Other Embodiment

Four image forming units have been used in the above-mentioned embodiments, but the invention is not limited thereto. As long as a plurality of image forming units is used, the number of image forming units is not limited and may be appropriately set.

Further, the structure where only the black image forming unit contains abrasive particles and the structure where all the image forming units contain abrasive particles have exemplified in the above-mentioned embodiments, but the invention is not limited thereto. The number of image forming units that contain abrasive particles and the positions of the image forming units in the moving direction of the belt may be appropriately set as needed.

Furthermore, a printer has been exemplified as the image forming apparatus in the above-mentioned embodiments, but the invention is not limited thereto. For example, the invention may be applied to another image forming apparatuses, such as a copying machine or a facsimile apparatus, or still another image forming apparatus, such as a complex machine having the functions of a copying machine and a facsimile apparatus. Further, the invention may be applied to an image forming apparatus that uses a recording material bearing member and sequentially superimposes and transfers toner images having various colors, which are formed on the respective image bearing members, on a recording material supported on the recording material bearing member. It may be possible to obtain the same effects by applying the invention to these image forming apparatuses.

Furthermore, in the above-mentioned embodiments, the amount of developer (the amount of supplied toner) supplied to the developing device of the first image forming portion has been exemplified as the information about the amount of toner consumed in the first image forming portion. Moreover, the image ratio (image duty) of an image, which is formed in the first image forming portion, has been exemplified as the information above. However, the information is not limited thereto.

Further, in the above-mentioned first embodiment, there has been exemplified the structure such that when the amount of toner used in the first image forming portion is larger than a predetermined amount of toner (T_total≧100), the amount of abrasive particles supplied by the supply unit is large in comparison with when the amount of toner used in the first image forming portion is smaller than the predetermined amount of toner. That is, even when the amount of toner used in the first image forming portion is smaller than the predetermined amount of toner (T_total≦100), abrasive particles have been supplied to the non-image area except when a predetermined toner image is formed in the non-image area on the photosensitive drum (T_total≦10). When the amount of toner used in the first image forming portion is larger than the predetermined amount of toner, the amount of abrasive particles supplied by the supply unit has been large in comparison with when the amount of toner used in the first image forming portion is smaller than the predetermined amount of toner. However, the invention is not limited thereto. Only when the amount of toner used in the first image forming portion is larger than the predetermined amount of toner (T_total≧100), the supply unit may supply abrasive particles to the abutting position between the photosensitive drum and the cleaning member. Even in this structure, it may be possible to suppress the instability of the amount of abrasive particles (which are supplied to the cleaning member of the second image forming portion) caused by the developer that is retransferred from the first image forming portion. Meanwhile, the first embodiment has been exemplified here, but this may be applied likewise to the second to fourth embodiments.

Furthermore, in the above-mentioned first embodiment, there has been exemplified the structure such that when the amount of toner used in the first image forming portion is smaller than a predetermined amount of toner (T_total≦10), the supply unit supplies toner to the abutting position between the photosensitive drum and the cleaning member. That is, only when the amount of toner used in the first image forming portion is smaller than the predetermined amount of toner (T_total≦10), a predetermined toner image has been formed on the photosensitive drum (image bearing member) of the second image forming portion. However, the invention is not limited thereto. When the amount of toner used in the first image forming portion is smaller than the predetermined amount of toner (T_total≦10), the amount of toner supplied by the supply unit may be large in comparison with when the amount of toner used in the first image forming portion is larger than the predetermined amount of toner. For example, when the amount of toner used in the first image forming portion is larger than the predetermined amount of toner (T_total>10), abrasive particles and toner are supplied to the non-image area except when more abrasive particles are formed in the non-image area on the photosensitive drum (T_total≧100). Further, when the amount of toner used in the first image forming portion is smaller than the predetermined amount of toner (T_total≦10), the amount of toner supplied by the supply unit is large in comparison with when the amount of toner used in the first image forming portion is larger than the predetermined amount of toner. Even in this structure, it may be possible to suppress the instability of the amount of abrasive particles (which are supplied to the cleaning member of the second image forming portion) caused by the developer that is retransferred from the first image forming portion. Meanwhile, the first embodiment has been exemplified here, but this may be applied likewise to the second to fourth embodiments.

Further, in the above-mentioned embodiments, the developing device has been exemplified as a supply unit that may supply abrasive particles or toner to the abutting position between the photosensitive drum and the cleaning member. (That is, the developing device has been used also as a supply unit.) However, the invention is not limited thereto. For example, a supply unit for supplying only abrasive particles may be provided separately from the developing device for supplying a developer that contains toner.

Furthermore, the structure where toner or abrasive particles are added (or start to be supplied) when T_total exceeds or is lower than a predetermined threshold value has been exemplified in the above-mentioned embodiments. However, the invention is not limited thereto. For example, control may be performed so that the amount of supplied abrasive particles is increased as the value of T_total is increased. Further, control may be performed so that the amount of supplied toner is decreased as the value of T_total is decreased.

According to the invention, it may be possible to suppress the instability of the amount of abrasive particles (which are supplied to the cleaning member of the second image forming portion) caused by the developer that is retransferred from the first image forming portion. Accordingly, it may be possible to provide an image forming apparatus that does not generate image stripes, image deletion, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-012473, filed Jan. 23, 2009, which is hereby incorporated by reference herein in its entirety.

What is claimed is:

1. An image forming apparatus comprising:

a first image forming portion that forms a toner image;

a second image forming portion that forms a toner; image, wherein the second image forming portion forms a toner image so that the toner image is superimposed on the toner image formed by the first image forming portion, wherein the second image forming portion includes an image bearing member, a cleaning member that removes toner existing on the image bearing member by abutting the image bearing member at an abutting position, and a supply unit that supplies abrasive particles or toner to the abutting position; and a controller that controls the amount of toners or abrasive particles, which are supplied by the supply unit, in accordance with the amount of toner used in the first and second image forming portions.

2. The image forming apparatus according to claim 1, wherein the controller performs a mode for supplying toner to the abutting position from the supply unit, in a case that the amount of toner used in the second image forming portion per a predetermined number of formed images is equal to or smaller than a predetermined lower limit, and wherein the controller changes the lower limit in accordance with the amount of toner used in the first image forming portion.

3. The image forming apparatus according to claim 2, wherein the controller controls the lower limit so that the lower limit is decreased as the amount of toner used in the first image forming portion is increased.

4. The image forming apparatus according to claim 1, wherein the controller performs a mode for supplying toner to the abutting position from the supply unit, wherein the controller performs a mode for supplying abrasive particles to the abutting position from the supply unit, in a case that the amount of toner used in the second image forming portion per a predetermined number of formed images is equal to or larger than a predetermined upper limit, and wherein the controller changes the upper limit in accordance with the amount of toner used in the first image forming portion.

5. The image forming apparatus according to claim 4, wherein the controller controls the upper limit so that the upper limit is decreased as the amount of toner used in the first image forming portion is increased.

6. The image forming apparatus according to claim 1, wherein the supply unit is a developing device that develops a latent image formed on the image bearing member.

7. The image forming apparatus according to claim 1, wherein the abrasive particles include strontium titanate.

8. The image forming apparatus according to claim 1, wherein the first image forming portion includes a plurality of image forming units that forms toner images, and the controller controls the amount of abrasive particles or toner supplied by the supply unit in accordance with the amount of toner used in each of the plurality of image forming units.

* * * * *